US006082595A

United States Patent [19]

Lin

[11] Patent Number: 6,082,595

[45] Date of Patent: Jul. 4, 2000

[54] DETERGENT DISPENSER WITH A WINDOW WIPER

[76] Inventor: Chung Sing Lin, No. 33-1, Ta Chiao 3rd Street, Yung Kang Shih, Tainan Hsien, Taiwan

[21] Appl. No.: 09/115,732

[22] Filed: Jul. 15, 1998

[51] Int. Cl.[7] ..... B67D 5/40

[52] U.S. Cl. ..... 222/192; 222/383.1; 401/139

[58] Field of Search ..... 222/192, 383.1; 401/139

[56] References Cited

U.S. PATENT DOCUMENTS

| | | | |
|---|---|---|---|
| D. 318,158 | 7/1991 | Ediger et al. | 401/139 |
| 3,008,164 | 11/1961 | Herman et al. | 401/139 |
| 4,273,459 | 6/1981 | Hardy | 222/192 |
| 4,516,676 | 5/1985 | Cournoyer | 401/139 |
| 4,776,716 | 10/1988 | Huang | 401/139 |
| 5,229,876 | 7/1993 | Singarella | 401/139 |

FOREIGN PATENT DOCUMENTS

| | | | |
|---|---|---|---|
| 2233217 | 1/1991 | United Kingdom | 401/139 |

*Primary Examiner*—Joseph A. Kaufman
*Attorney, Agent, or Firm*—Bacon & Thomas

[57] ABSTRACT

A detergent dispenser with a window wiper includes a dispenser body, a connector fixed with an outer wall of the dispenser body, and a window wiper releasably fitted in the connector, to permit spraying a detergent and cleaning.

6 Claims, 29 Drawing Sheets

DETERGENT DISPENSER WITH A WINDOW WIPER

BACKGROUND OF THE INVENTION

This invention relates to a detergent dispenser with a window wiper, and particularly to one provided with a window wiper releasably sandwiched in a connector fixed with the dispenser body for convenience of performing cleaning work.

In cleaning work such as cleaning windows, a detergent dispenser and a separate window wiper are necessary. At present these two items are supplied independently and held by a user separately, resulting in inconvenience in cleaning work, especially in changing a position or climbing a ladder to a high location.

SUMMARY OF THE INVENTION

This invention provides a detergent dispenser with a window wiper releasably sandwiched in a connector fixed with the dispenser body for convenience.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
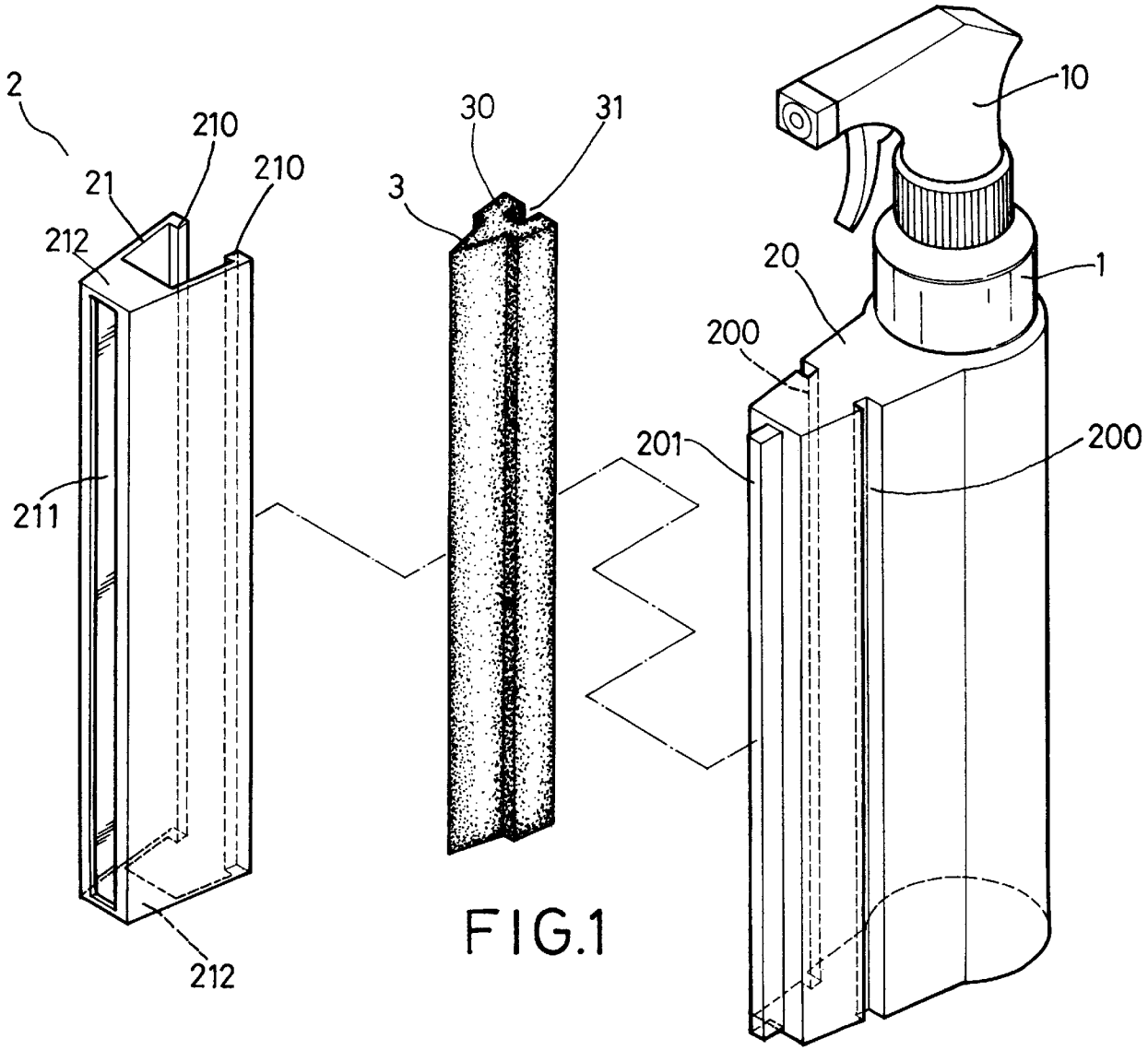
FIG. 1 is an exploded perspective view of a first embodiment of a detergent dispenser with a window wiper in the present invention.
Figure 2:
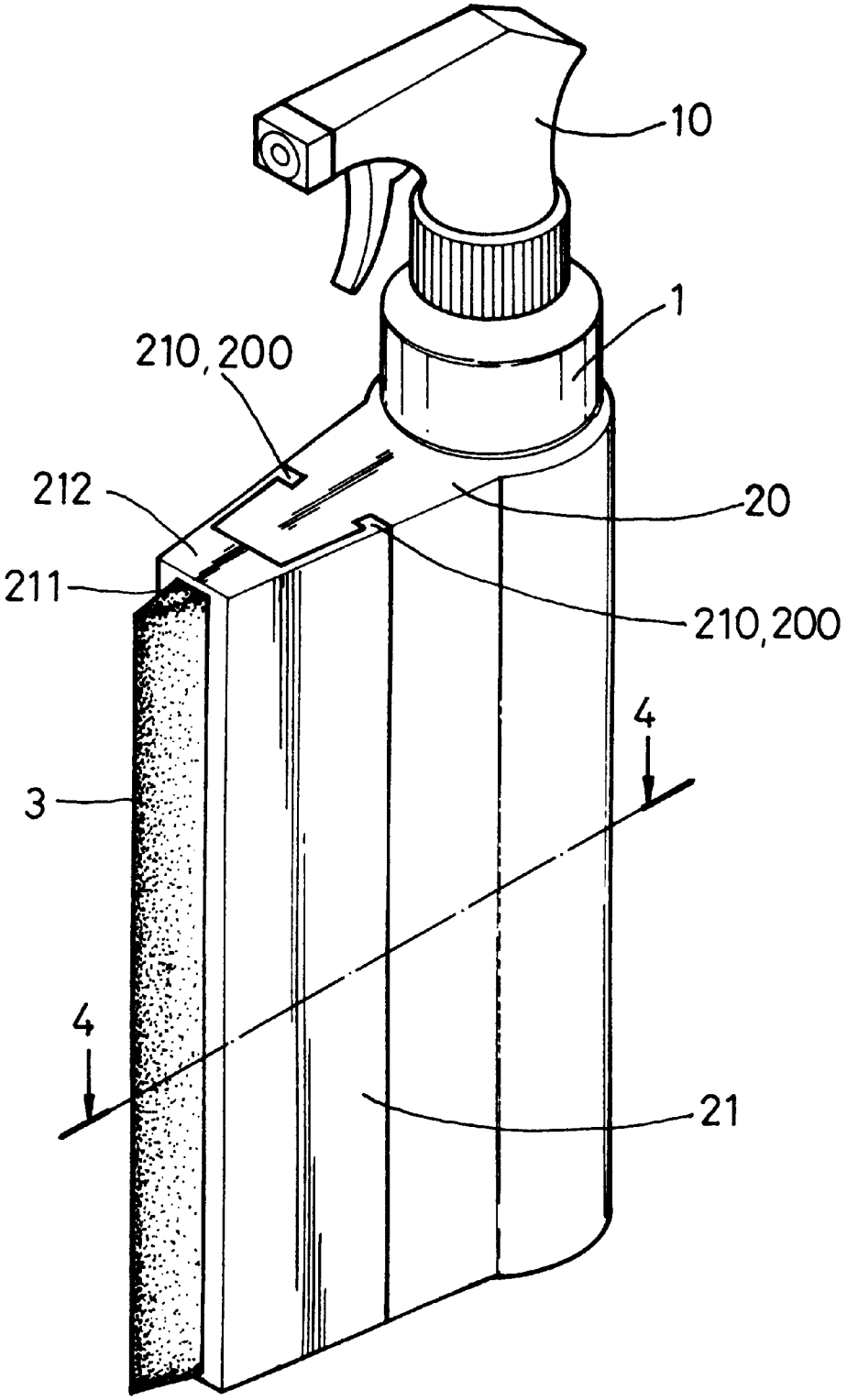
FIG. 2 is a perspective view of the first embodiment of a detergent dispenser with a window wiper in the present invention.
Figure 3:
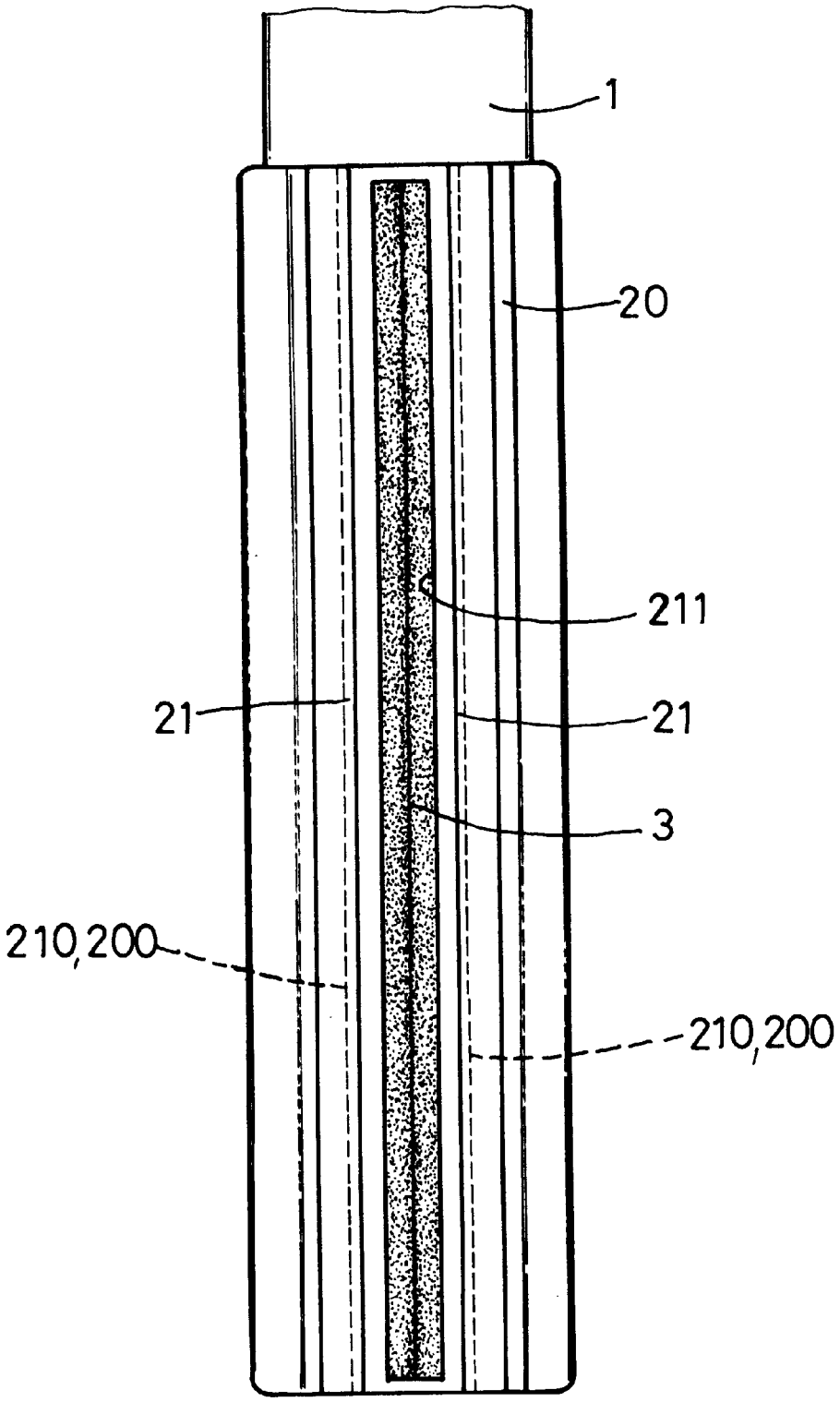
FIG. 3 is a front view of the first embodiment of a detergent dispenser with a window wiper in the present invention.
Figure 4:
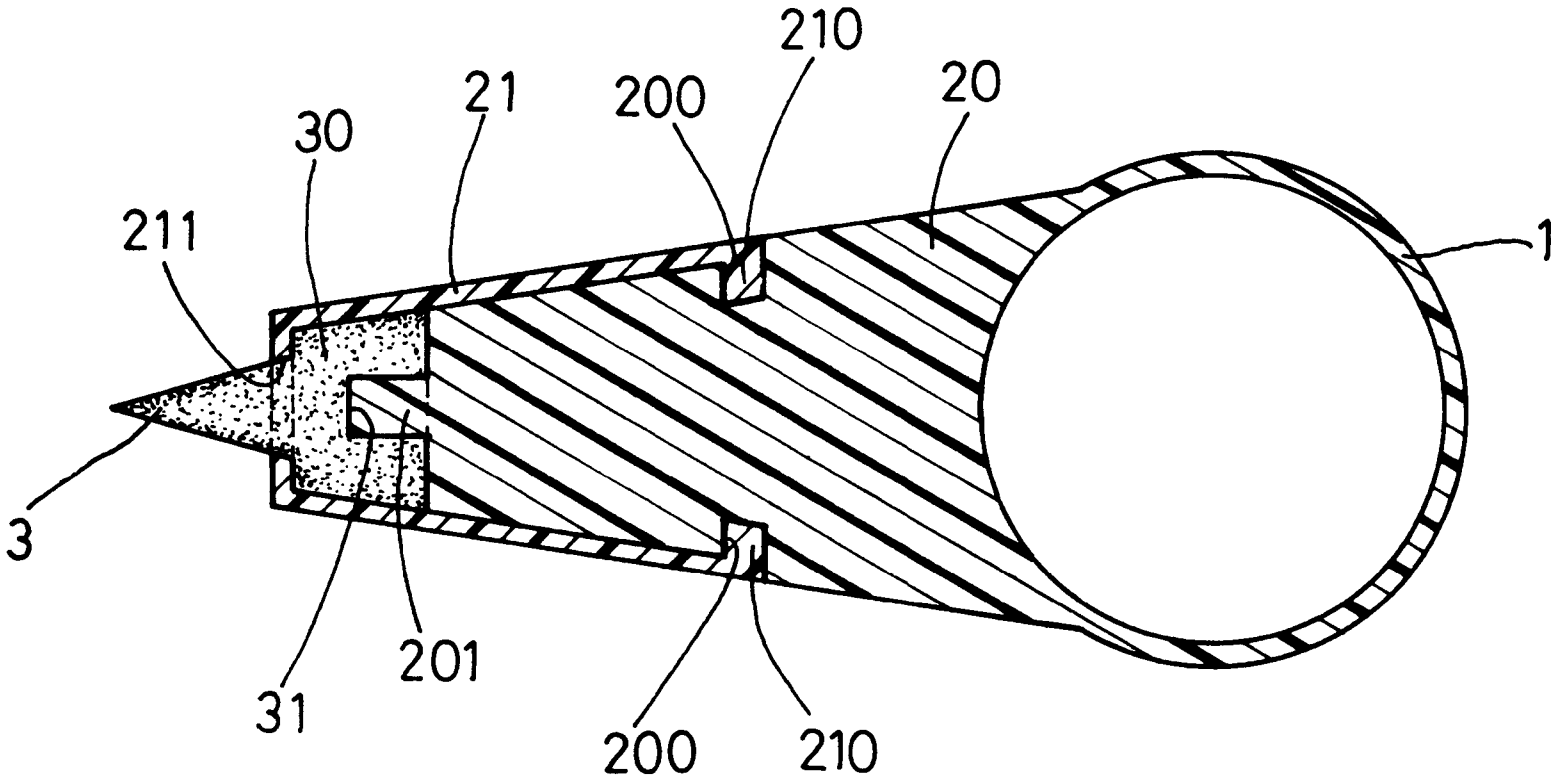
FIG. 4 is a cross-sectional view of line 4—4 in FIG. 2.

A first embodiment of a detergent dispenser with a window wiper in the present invention, as shown in FIGS. 1 and 2, includes a dispenser body 1, a connector 2 and a window wiper 3 as the main components.

The dispenser body 1 is a can filled with a detergent, and having a spray nozzle fixed on an opening in an upper end for spraying the detergent in the dispenser body 1 out to a location to be cleaned.

The connector 2 consists of a connector base 20 fixed firmly and vertically on an outer wall of the dispenser body 1 and a cover 21 closed on the connector base 20. Connector base 20 extends in the same direction as a spray nozzle 10. A window wiper 3 is fixed between the connector base 20 and the cover 21.

The connector base 20 is vertically fixed on an outer wall of the dispenser body 1, having two opposite side walls tapering toward the front side, and an elongate vertical groove 200 respectively formed in each side wall for engagement with two lips 210 of the cover 21 and, a vertical elongate projection 201 formed at the front for engagement with an elongate groove 31 of the wiper 3. The window wiper 3 has a U-shaped elongate base 30 with the elongate groove 31 formed in a rear side.

The cover 21 closes on the front portion of the connector base 20, with the wiper 3 sandwiched between the cover 21 and the connector base 20, thereby preventing the wipers from falling. The cover 212 has an opening in a rear side and a front side, with the rear opening fitting in the front side of the connector base 20. The rear opening of the cover 21 is formed with two lips 210 fitting in the elongate groove 200 of the connector base 20 (the two lips 210 can move along the two tapered walls of the connector base 20 to fit in the grooves 200 very easily). The cover 21 further has a front elongate opening 211 for the pointed front edge of the wiper 3 to protrude through, and the circumferential edge of the opening 211 contacts the front of the base 30 of the wiper 3 so as to prevent the wiper 3 from falling out of the opening 211. Thus the wiper 3 is securely sandwiched between the cover 21 and the connect base 20. The cover 21 further has a side wall 212 formed respectively at an upper side and a lower side to hide the upper side and the lower side of the base 30 of the wiper 3 and prevent the wiper 3 from moving up and down.

The first embodiment of a detergent dispenser with a window wiper has a connector 2 for releasably fixing the window wiper 3 indirectly on the dispenser body 1, and the spray nozzle 10 is positioned in the same direction as the window wiper 3 so that a user is not obliged to turn the dispenser body when spraying detergent during cleaning and wiping. Further, the window wiper 3 is sandwiched between the cover 21 and the connector base 20, and it is quite easy to take off the cover 21 and the window wiper 3 when necessary.

Figure 5:
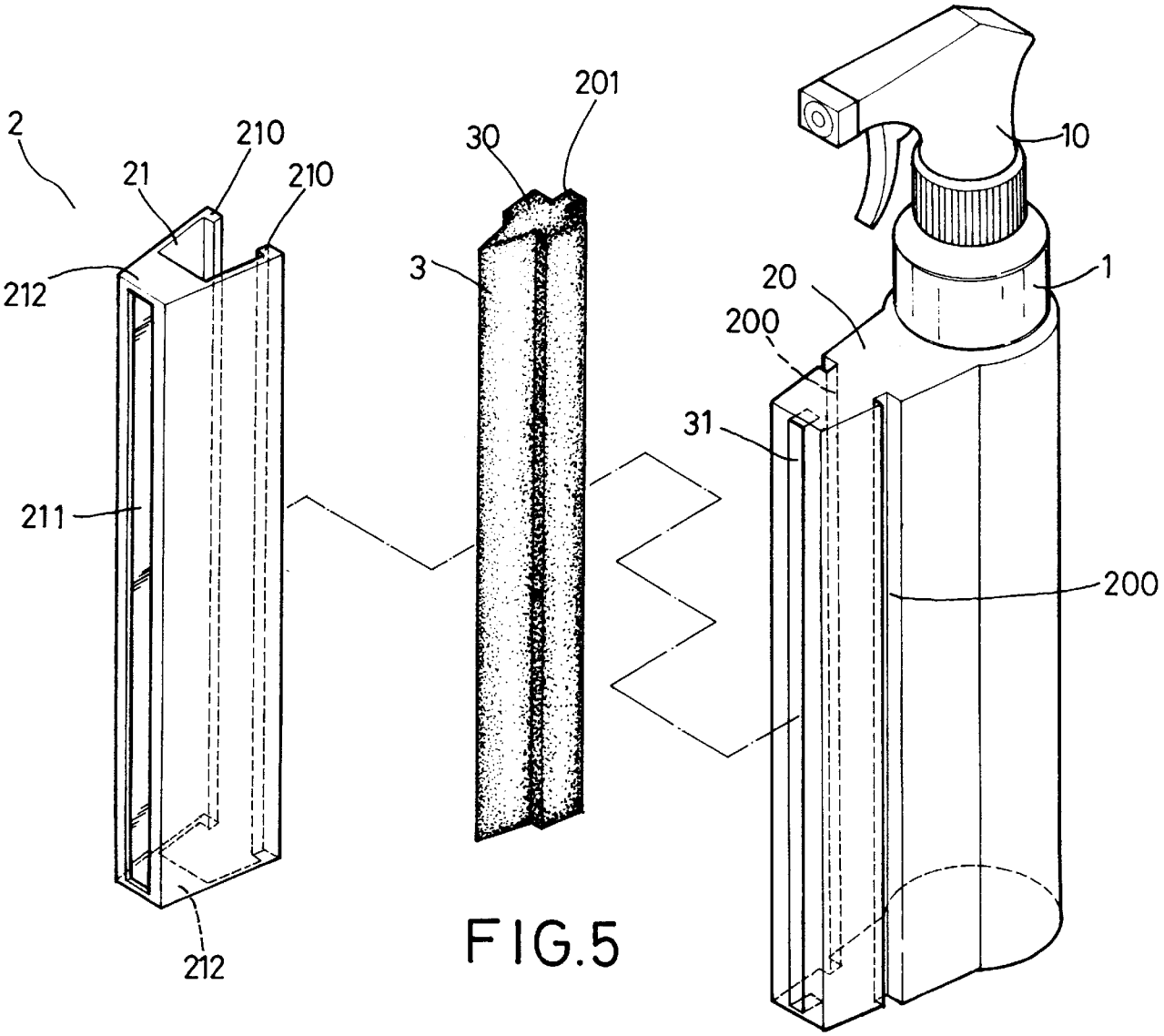
FIG. 5 is an exploded perspective view of a second embodiment of a detergent dispenser with a window wiper in the present invention.
Figure 6:
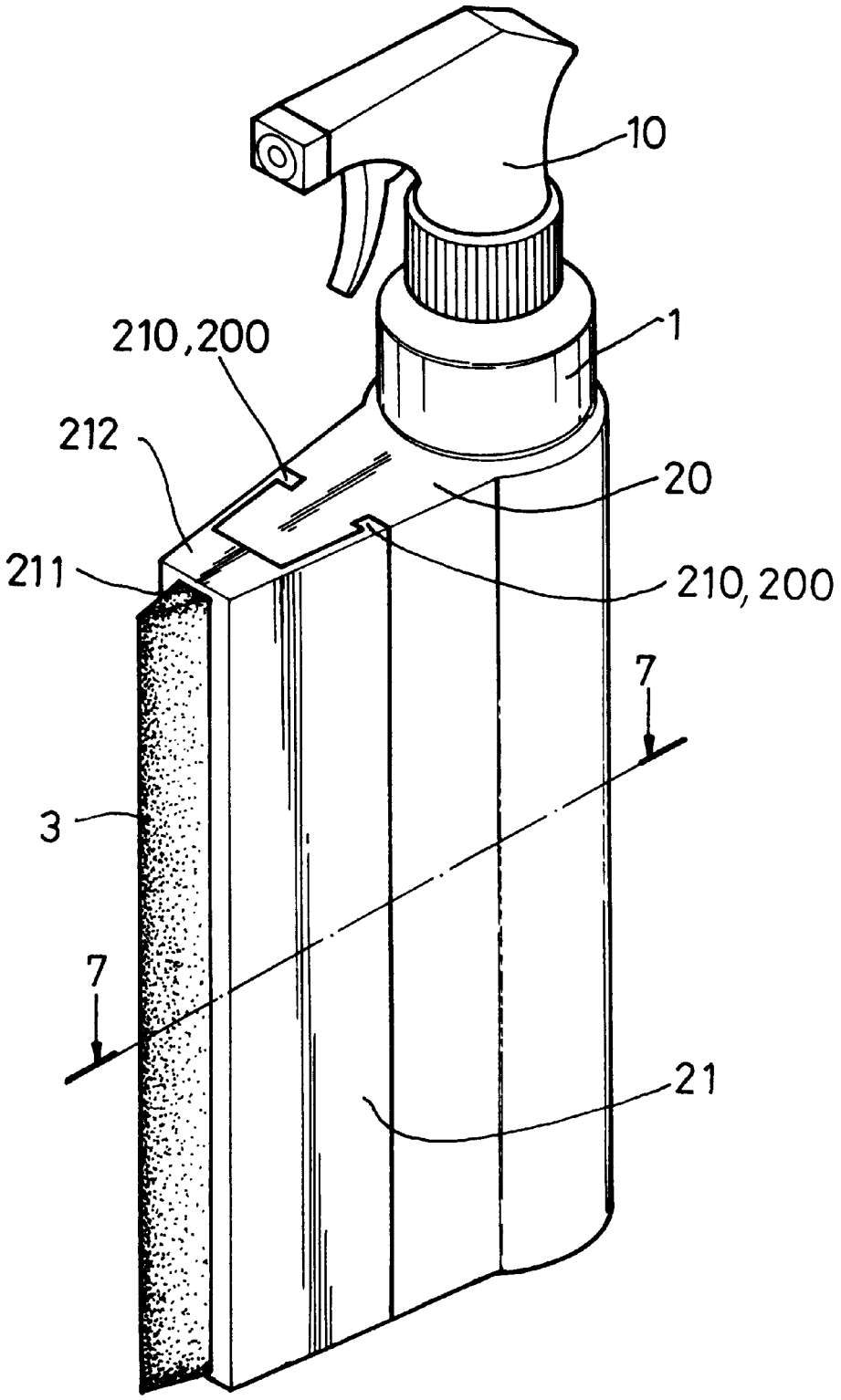
FIG. 6 is a perspective view of the second embodiment of a detergent dispenser with a window wiper in the present invention.
Figure 7:
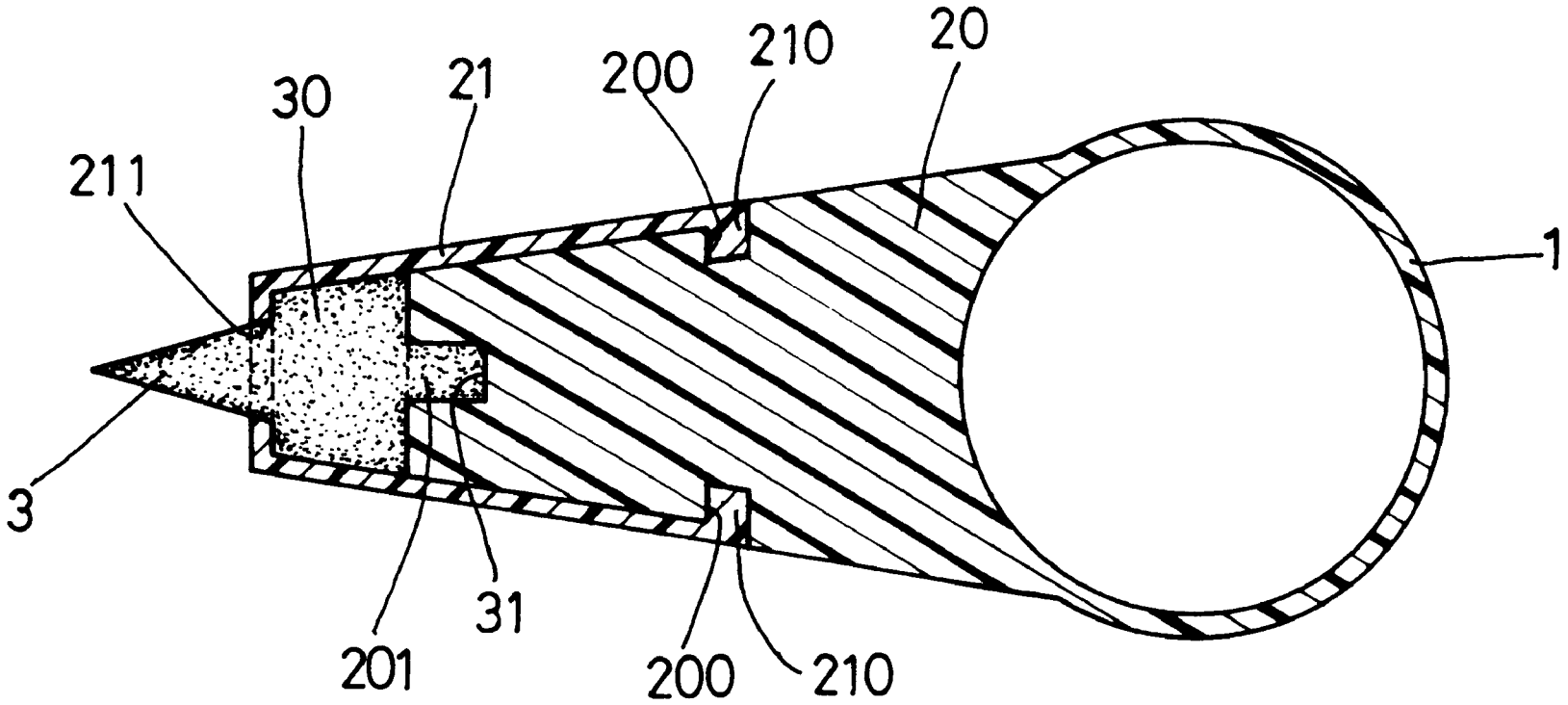
FIG. 7 is a cross-sectional view of line 7—7 in FIG. 6.
Figure 8:
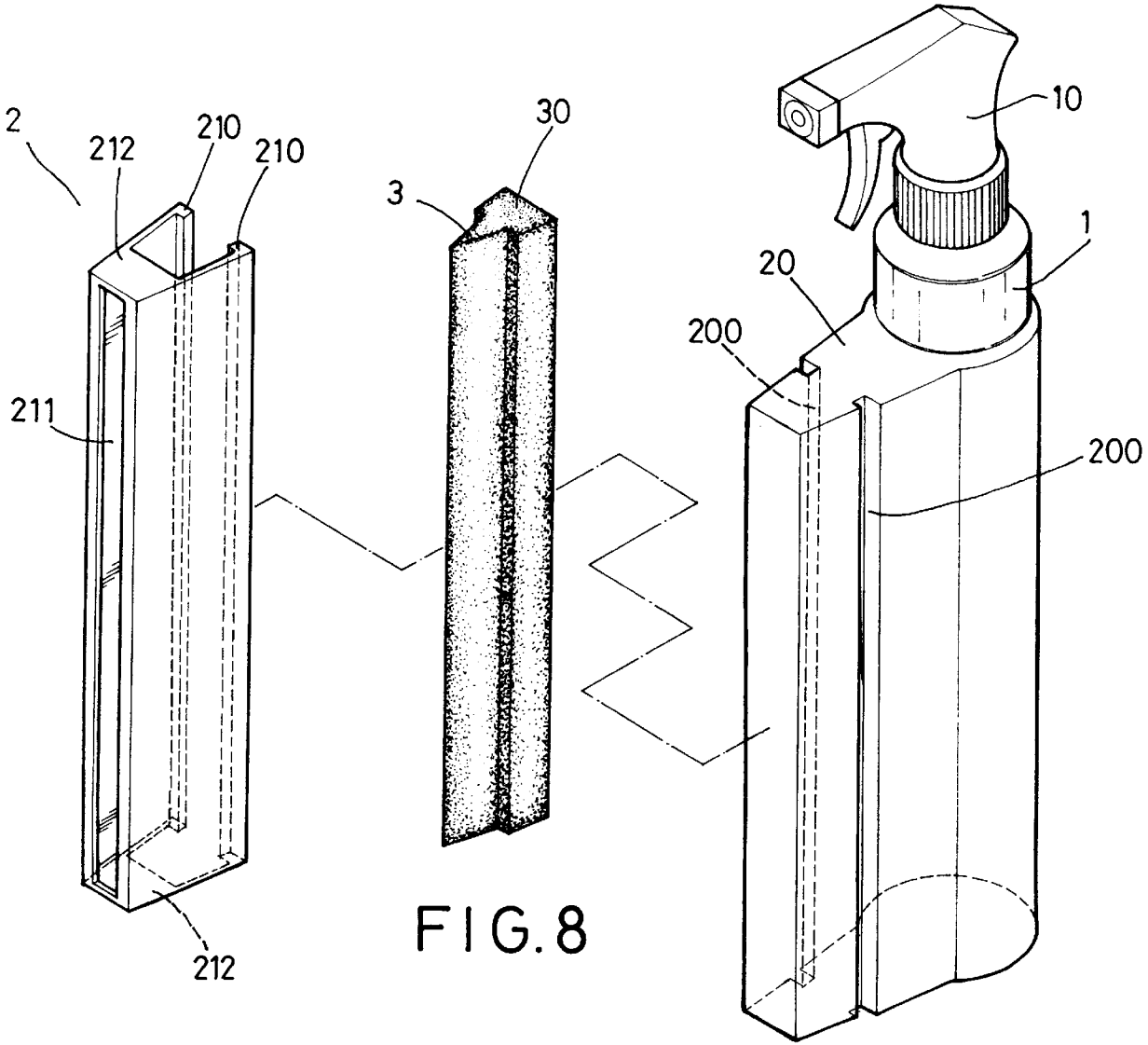
FIG. 8 is an exploded perspective view of a third embodiment of a detergent dispenser with a window wiper in the present invention.
Figure 9:
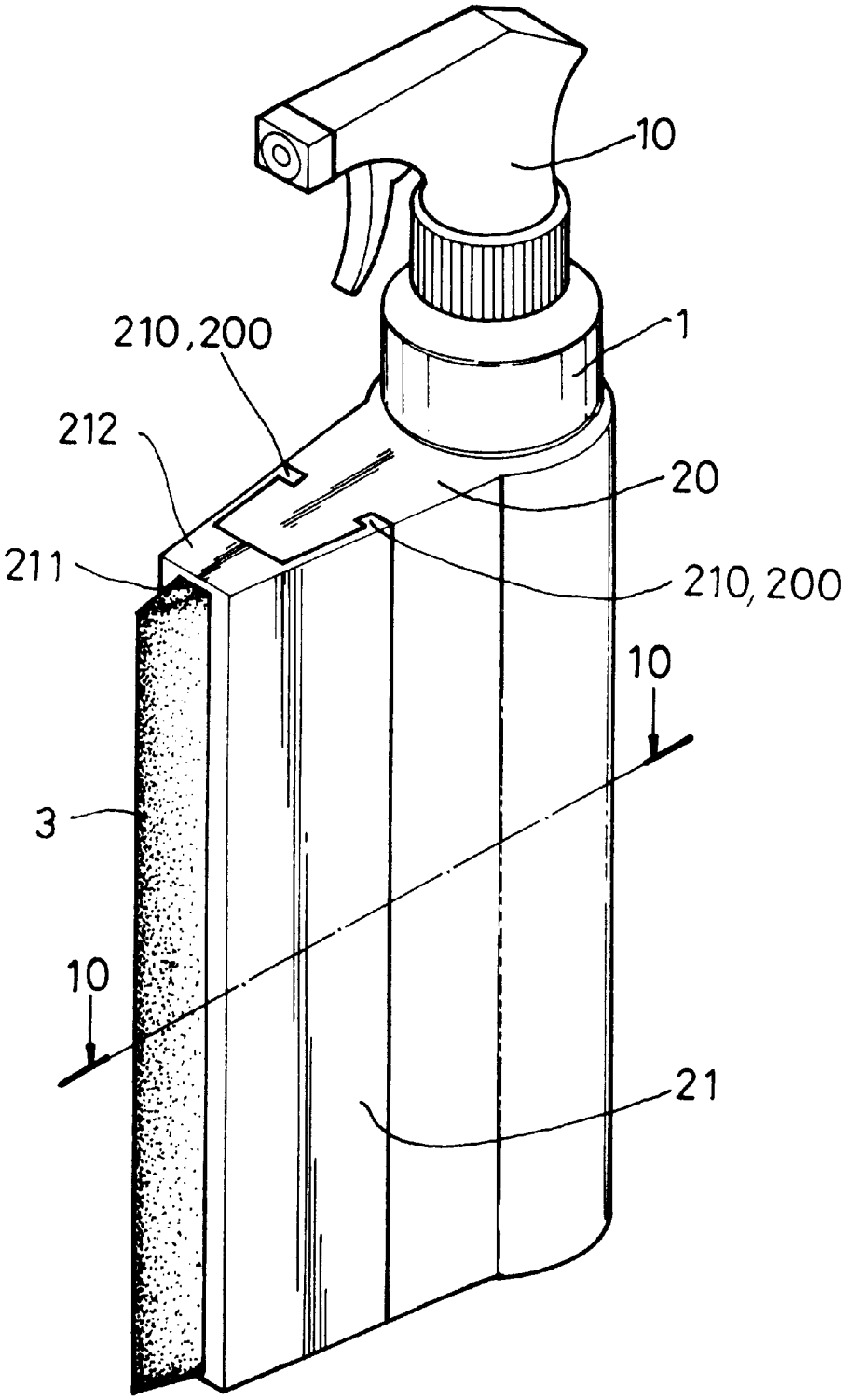
FIG. 9 is a perspective view of the third embodiment of a detergent dispenser with a window wiper in the present invention.
Figure 10:
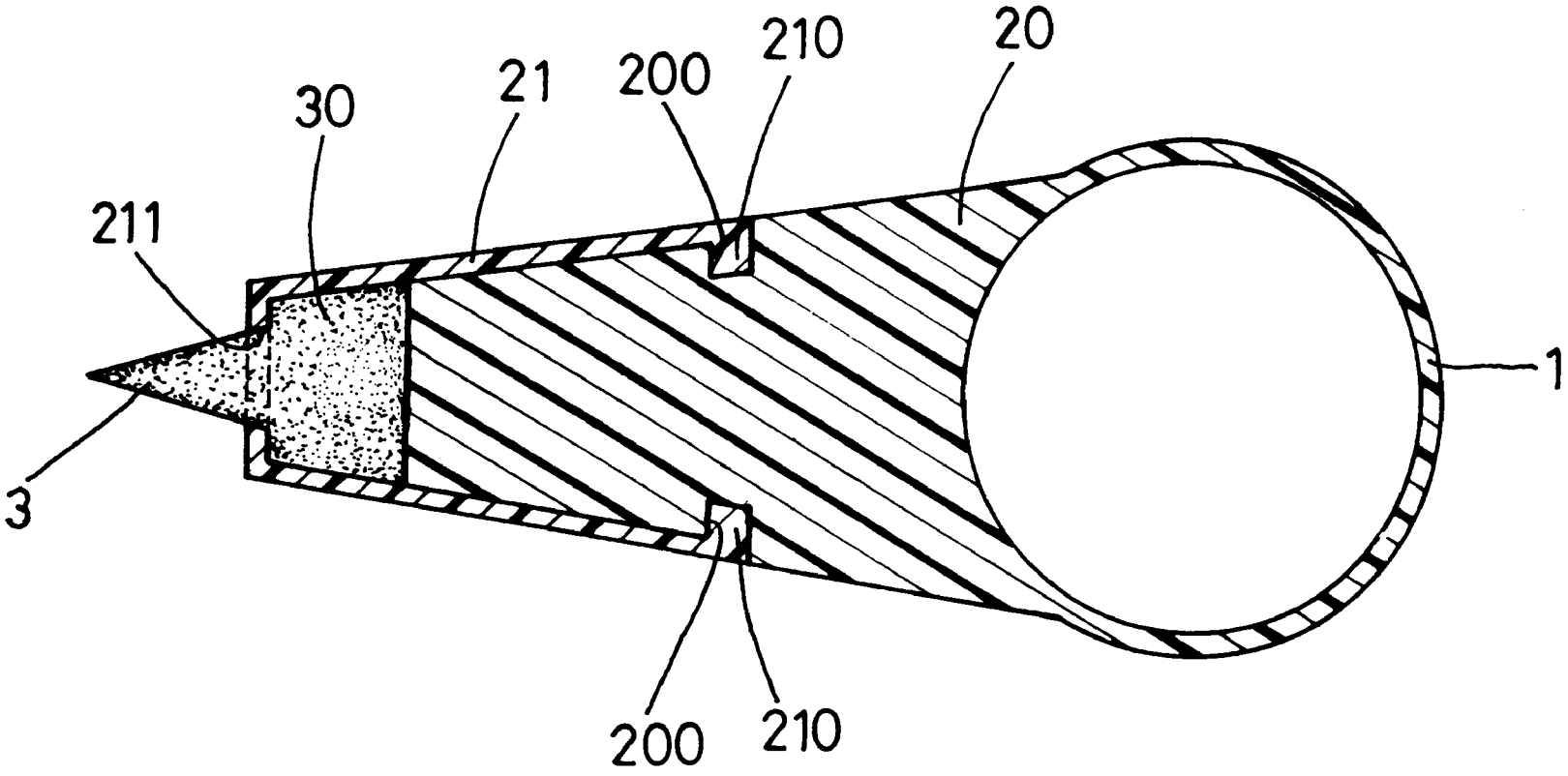
FIG. 10 is a cross-sectional view of line 10—10 in FIG. 9.

FIGS. 5, 6 and 7 show a second embodiment of a detergent dispenser with a window wiper in the present invention, and FIGS. 8, 9 and 10 show a third embodiment. Both these embodiments include a dispenser body 1, a connector 2 consisting of a connector base 20 and a cover 21, and a window wiper 3 as the first embodiment, but the difference comprises the connecting structure of the connector base 20 and the wiper 3. The second embodiment has an elongate vertical groove 31 in the connector base 20 instead of the elongate vertical projection 201, and an elongate vertical projection 201 formed in the wiper 3 instead of the vertical elongate groove 31 to engage the groove 31, as shown in FIG. 7. The third embodiment has a flat rear side formed in the window wiper 3 and a flat front side formed in the connector base 20 to contact each other, as shown in FIG. 10.

Figure 11:
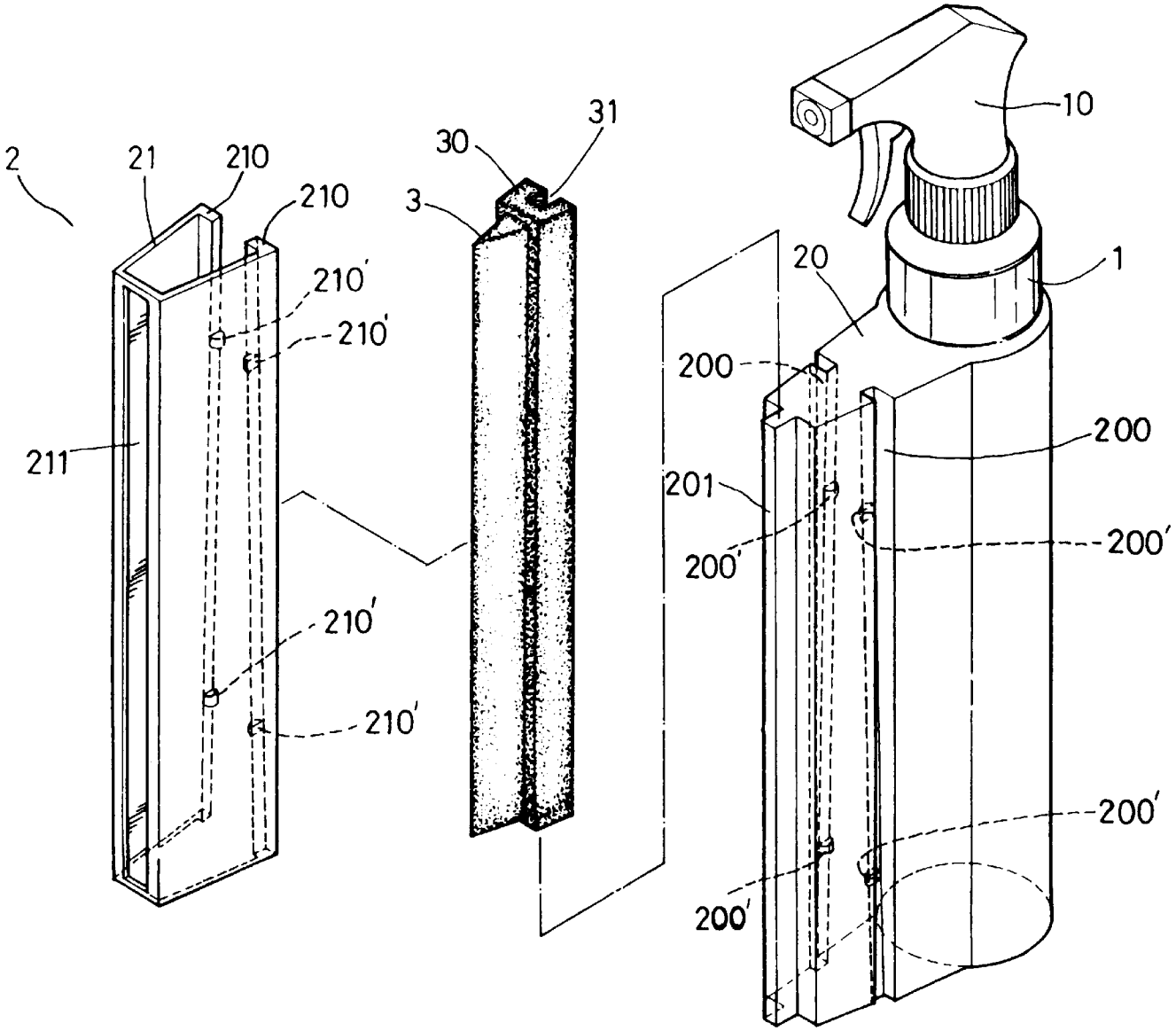
FIG. 11 is an exploded perspective view of a fourth embodiment of a detergent dispenser with a window wiper in the present invention.
Figure 12:
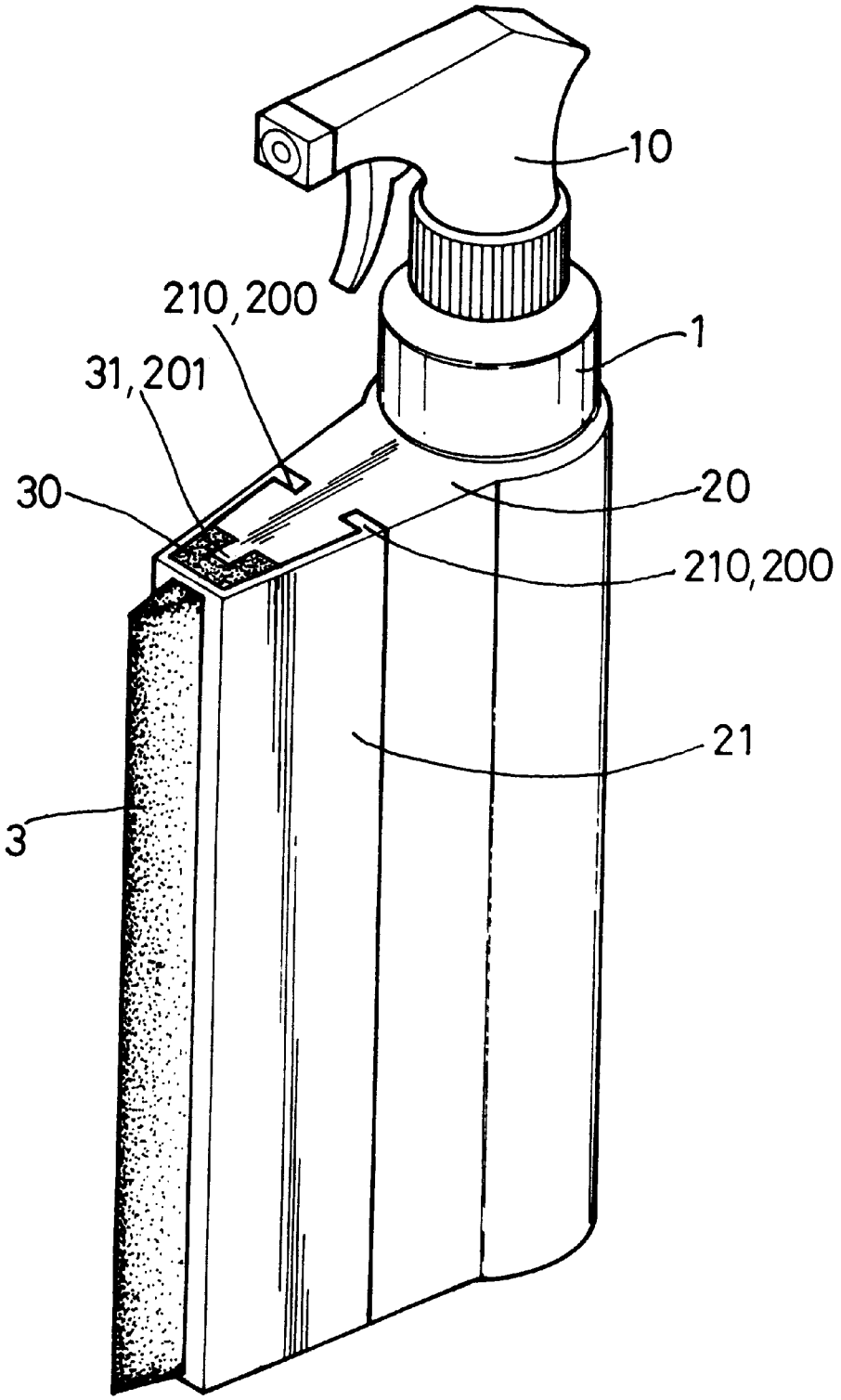
FIG. 12 is a perspective view of the fourth embodiment of a detergent dispenser with a window wiper in the present invention.

A fourth embodiment, shown in FIGS. 11 and 12, has an easier structure for the cover 21 and the window wiper 3 to combine with the connector 20 than the first, the second and the third embodiments. The fourth embodiment has almost the same structure as the first one, including a dispenser body 1, a connector 2 consisting of a connector base 20 and a cover 21. The cover 21 has an open upper and lower side, not stopping the upper and the lower side of the wiper 3 so that the wiper 3 may be fitted in the cover 21 first, and then the wiper 3 together with the cover 21 may be combined with the connector base 20 by pushing the both 21 the cover and the wiper 3 downward. The with an elongate groove 31 of the wiper 3 and the lips 210 of the cover 21 fit with an elongate projection 201 and two opposite elongate grooves 200. This is advantageous to assemble directly the cover 21 and the wiper 3 together with the connector base 20.

Further, in the fourth embodiment, in order to facilitate the inserting and lowering action of the lips 210 of the cover 21 in the grooves 200 of the connector base 20, the lips 210 and the grooves 200 are preferably made to have the upper portion wide and gradually narrowing down towards the lower portion. In addition, each groove 200 has one or two small recesses 200' formed in an inner wall defining the groove 200, and each lip 210 has one or two projecting points 210' fitting in the small recesses 200' to keep the lips 210 from loosening off of the grooves 200.

Figure 13:
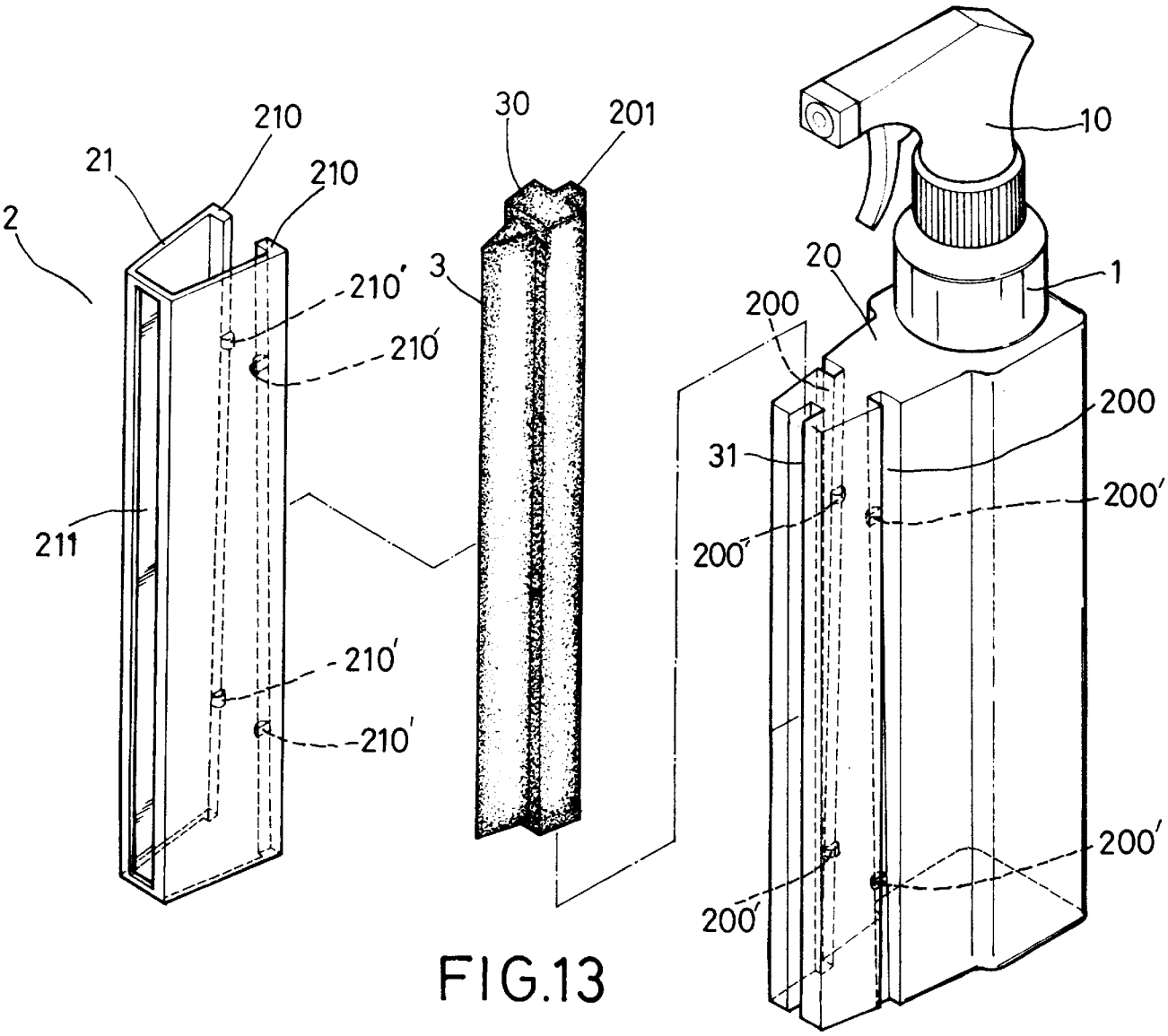
FIG. 13 is an exploded perspective view of a fifth embodiment of a detergent dispenser with a window wiper in the present invention.
Figure 14:
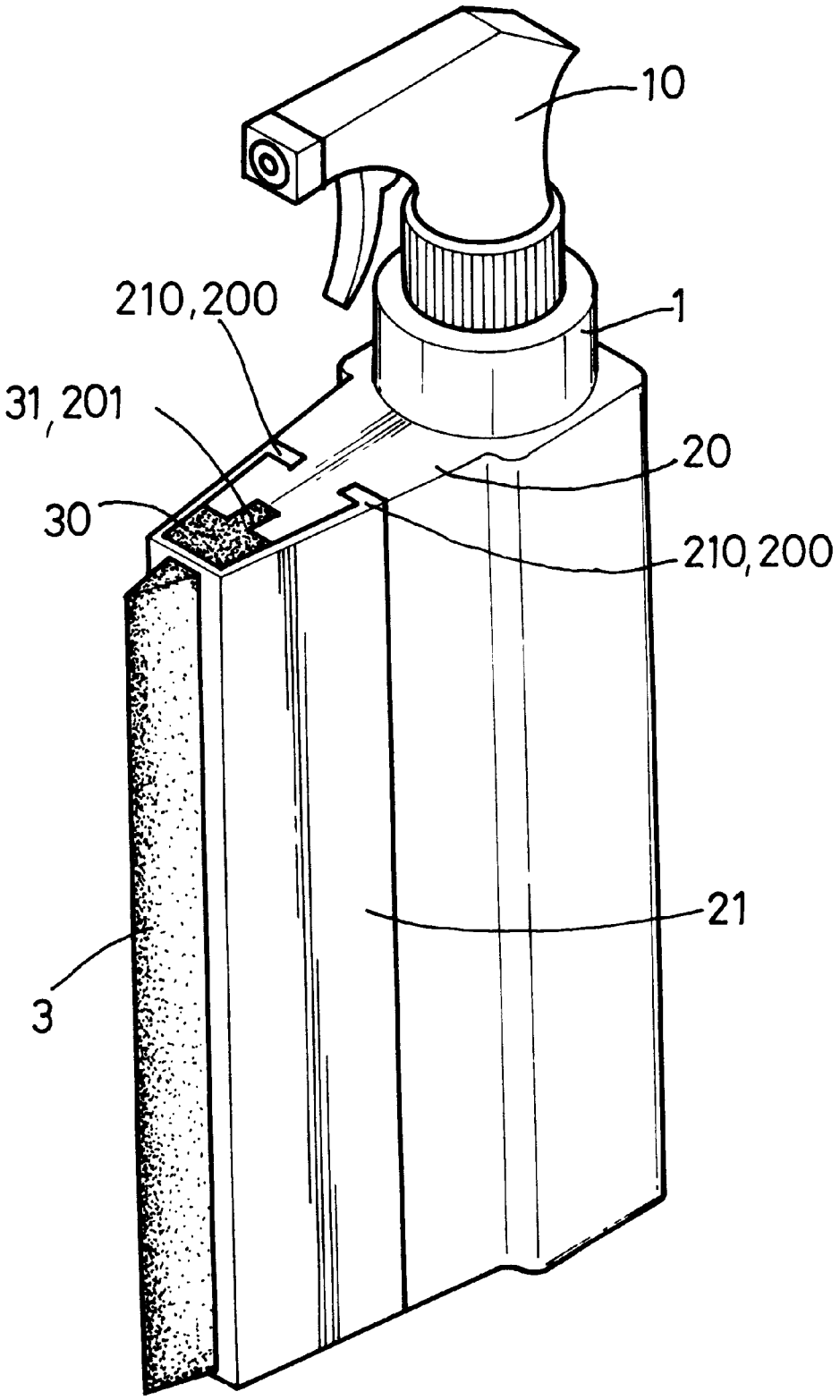
FIG. 14 is a perspective view of the fifth embodiment of a detergent dispenser with a window wiper in the present invention.

FIGS. 13 and 14 show a fifth embodiment of the invention, having almost the same structure as the fourth embodiment, except the connector base 20 having an elongate groove 31 instead of the elongate projection 201, and the window wiper 3 having an elongate projection 201 on a rear side instead of the elongate groove 31 to fit with each other. Then the cover 21 together with the window wiper 3 may be inserted from upside downward in the connector base 20 in the same way as the fourth embodiment.

Figure 15:
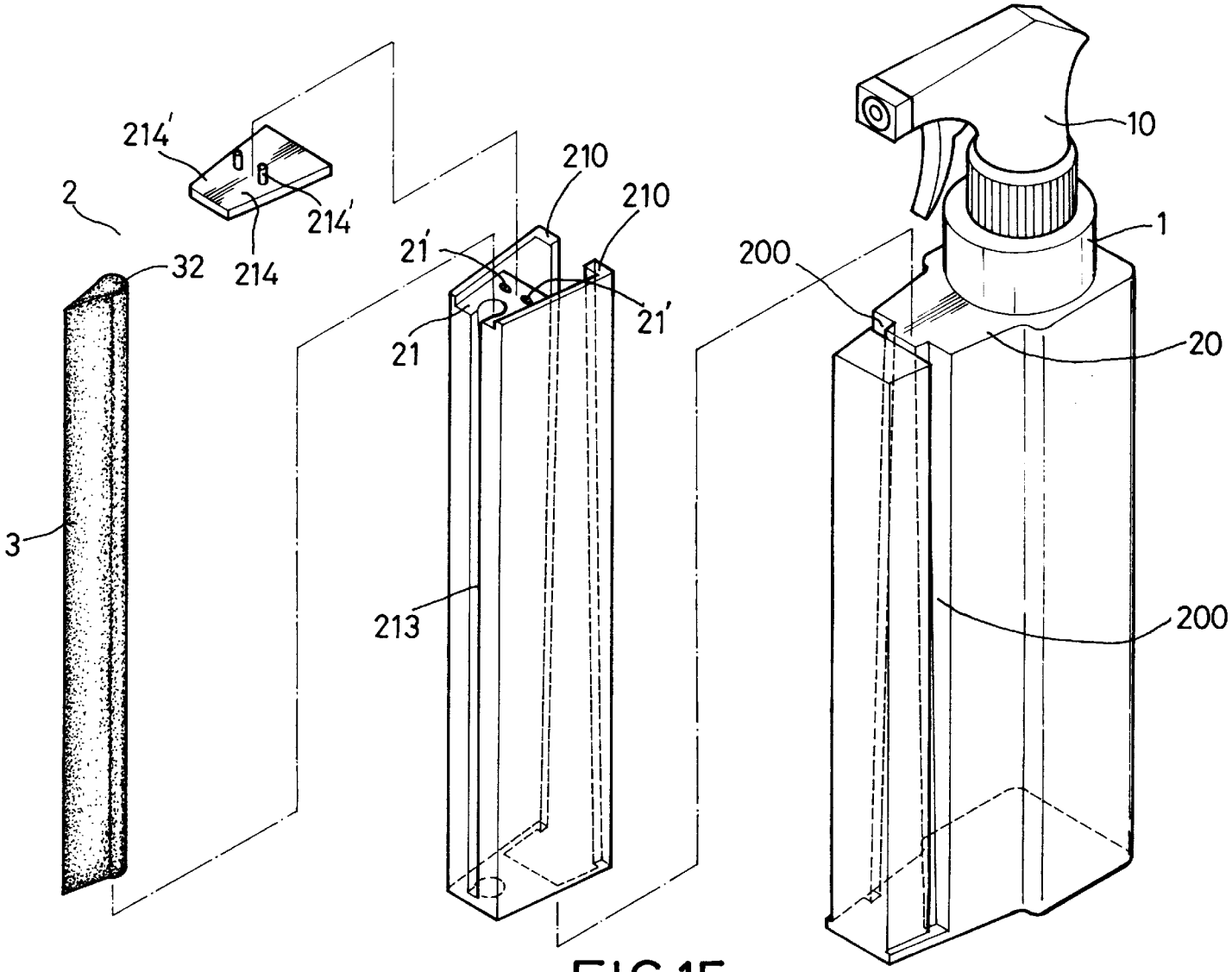
FIG. 15 is an exploded perspective view of a sixth embodiment of a detergent dispenser with a window wiper in the present invention.
Figure 16:
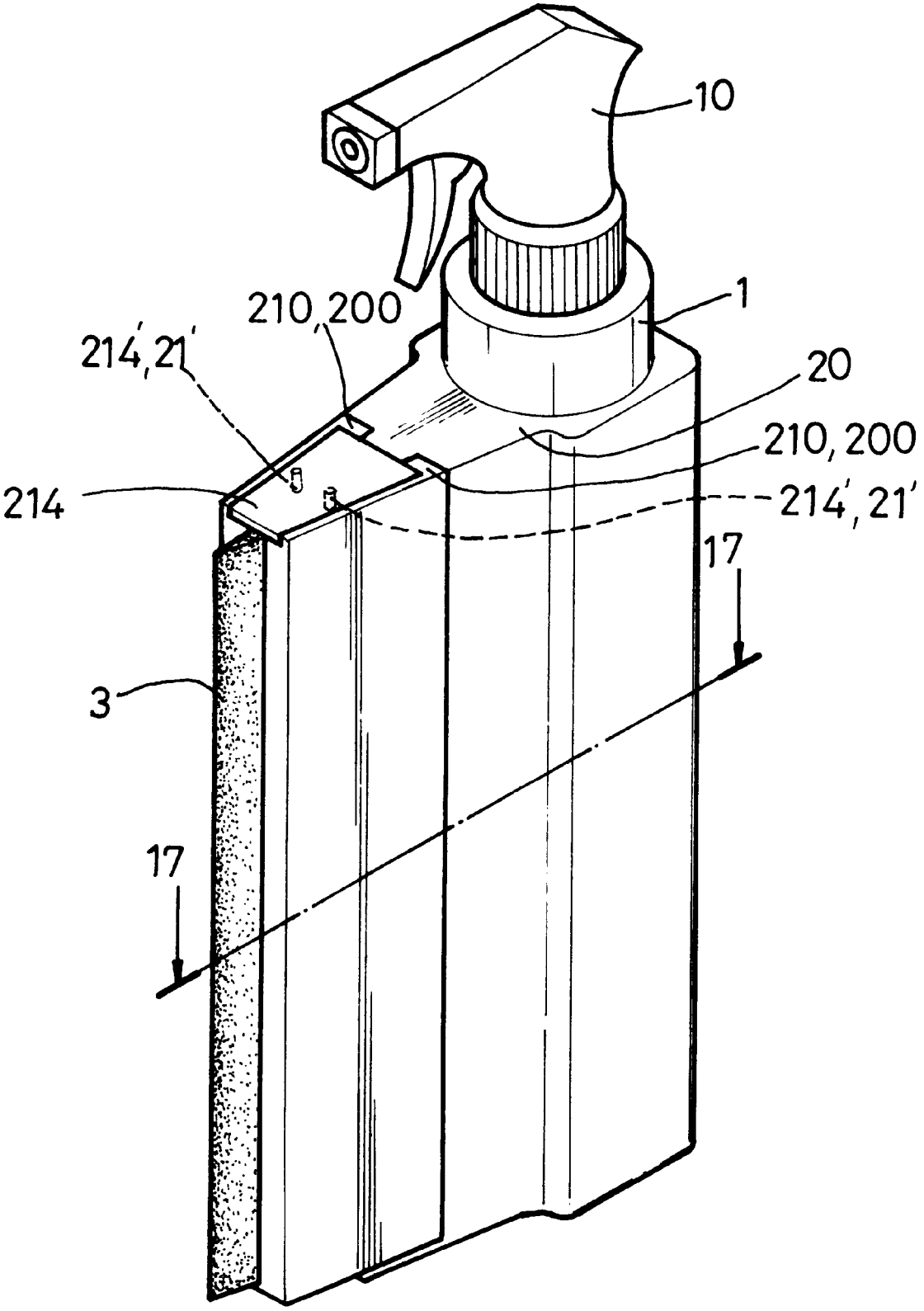
FIG. 16 is a perspective view of the sixth embodiment of a detergent dispenser with a window wiper in the present invention.
Figure 17:
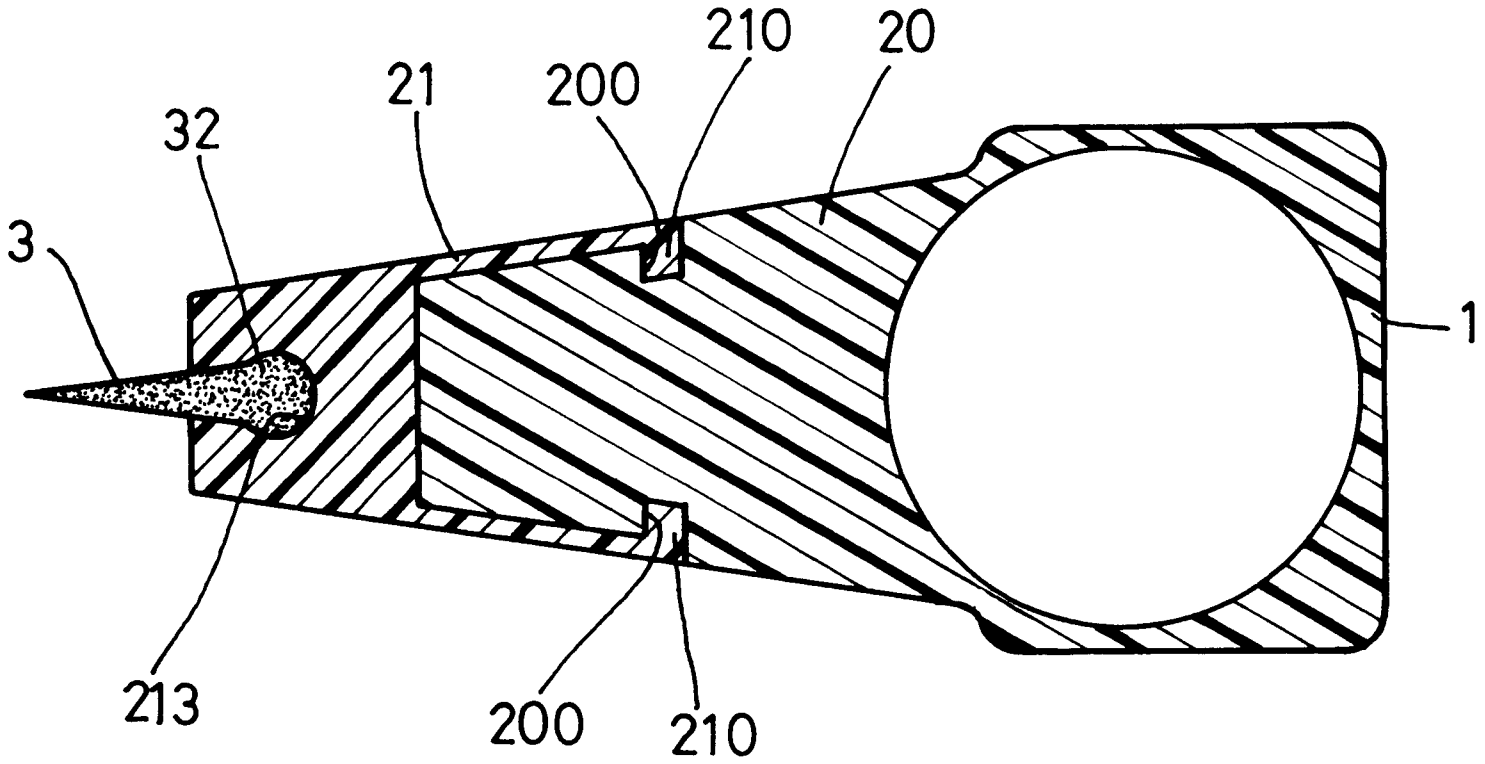
FIG. 17 is a cross-sectional view of line 17—17 in FIG. 16.

FIGS. 15 and 16 show a sixth embodiment of the invention, also including a dispenser body 1, a connector 2 consisting of a connector base 20 and a cover 21, and a window wiper 3 as all the other embodiments, with the wiper 3 sandwiched between the connector base 20 and the cover 21. But the sixth embodiment has a wiper 3 inserted in the front of the cover 21.. The connector base 20 and the cover 21 have the same combining structure as the former embodiments, with lips 210 formed in the cover 21 and elongate grooves 200 formed in the connector base 20 for mutual vertical insertion, and with the lower ends of the grooves 200 sealed and maintaining the cover 21 immovable after insertion in the grooves 200. The cover 21 further has a vertical elongate aperture 213 with a wide inner portion and a narrow outer portion, and the wiper 3 has a rear elongate Portion 32 of the same shape as the aperture 213 to engage the aperture 213 so as to combine the wiper 3 with the cover 21, as shown in FIG. 17. The vertical elongate aperture 213 is sealed at the lower end, thus preventing the wiper 3 from further sliding down after being engaged with the cover 21. In addition, a flat cap 214 is provided to close the upper end of the cover 21, thus preventing the wiper from moving up and securely fixing the wiper 3 in the aperture 213, i.e. in the cover 21, as shown in FIG. 16. The flat cap 214 closes on the upper end of the cover 21, and having two tenons 214' extending down from an inner side and engaging two mortises 21' provided in the upper end of the cover 21 with the upper surface of the flat cap 214 flush with the outer edge of the cover 21 and with the upper end surface to present a flat appearance after the flat cap 214 is closed on the cover 21.

Figure 18:
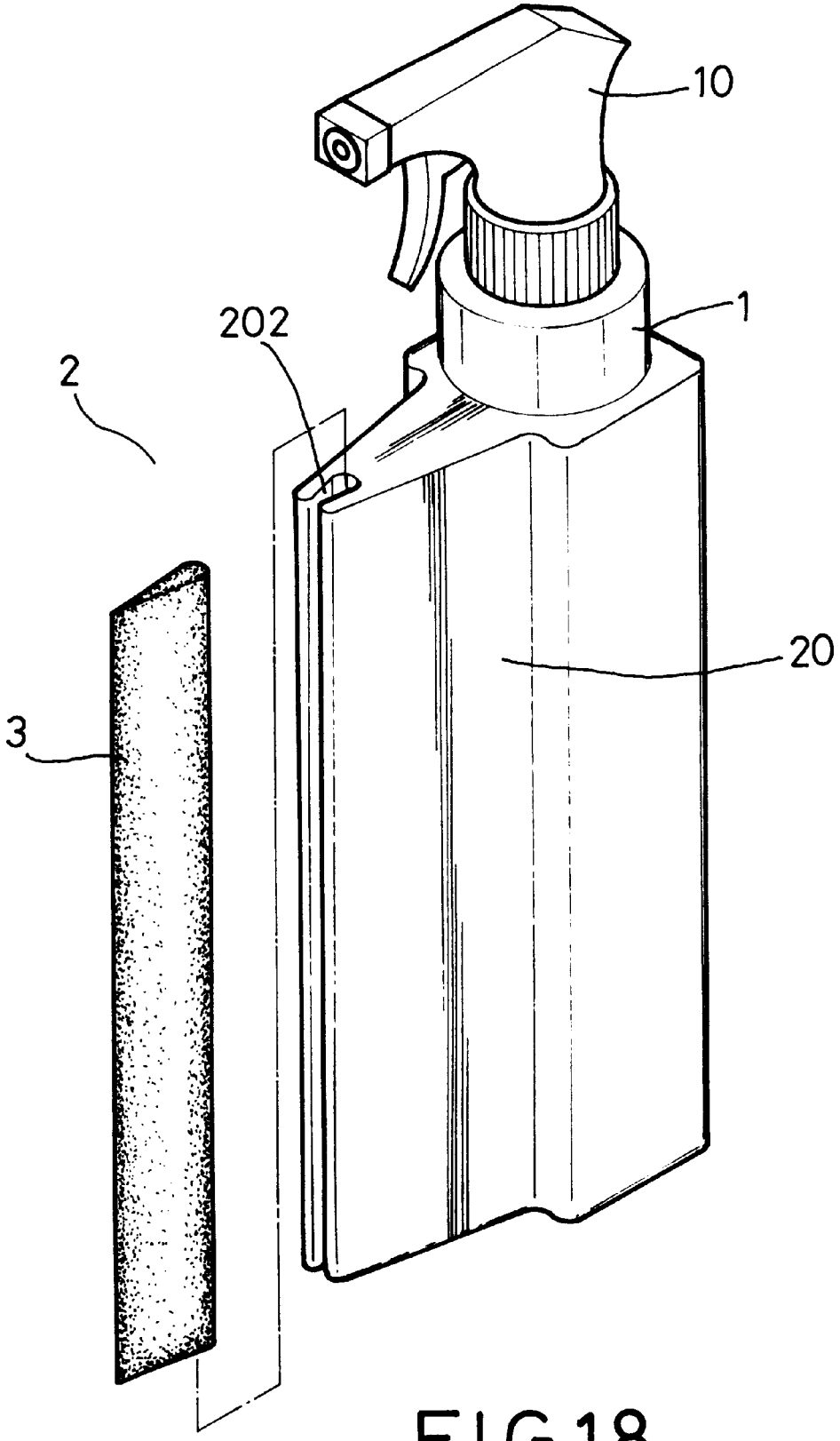
FIG. 18 is an exploded perspective view of a seventh embodiment of a detergent dispenser with a window wiper in the present invention.
Figure 19:
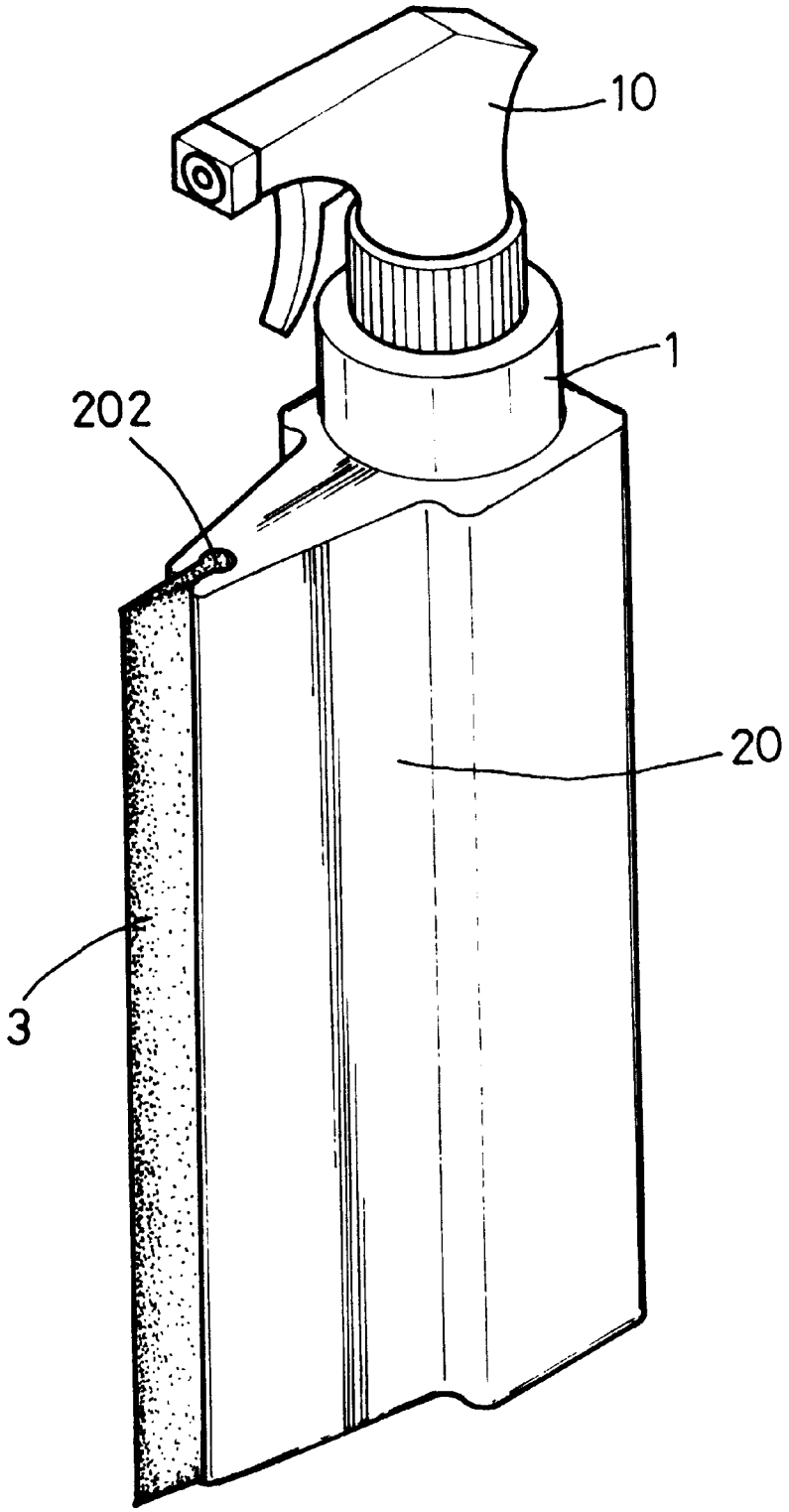
FIG. 19 is a perspective view of the seventh embodiment of detergent dispenser with a window wiper in the present invention.

FIGS. 18 and 19 show the seventh embodiment of the invention, and having a little difference from the former embodiments, is that the connector 2 does not includes cover 21 of the former embodiments, is formed integral with the dispenser body 1 and provided with a vertical elongate aperture 202 (with a rear wide portion and a front narrow portion) for engagement the by wiper 3. The wiper 3 has a rear vertical elongate member 31 of the same shape as the aperture 202 to engage the aperture 202.

Figure 20:
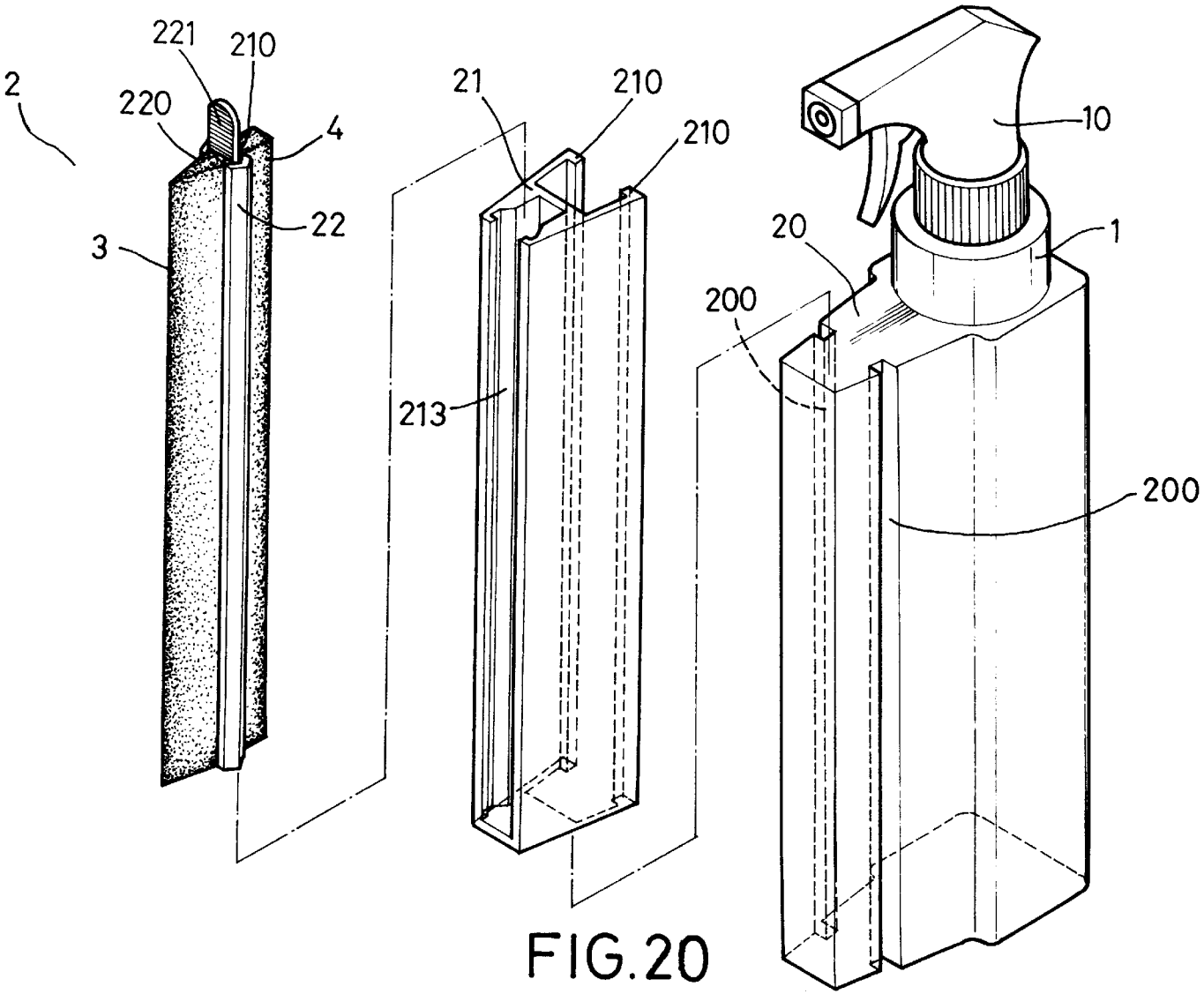
FIG. 20 is an exploded perspective view of an eighth embodiment of a detergent dispenser with a window wiper in the present invention.
Figure 21:
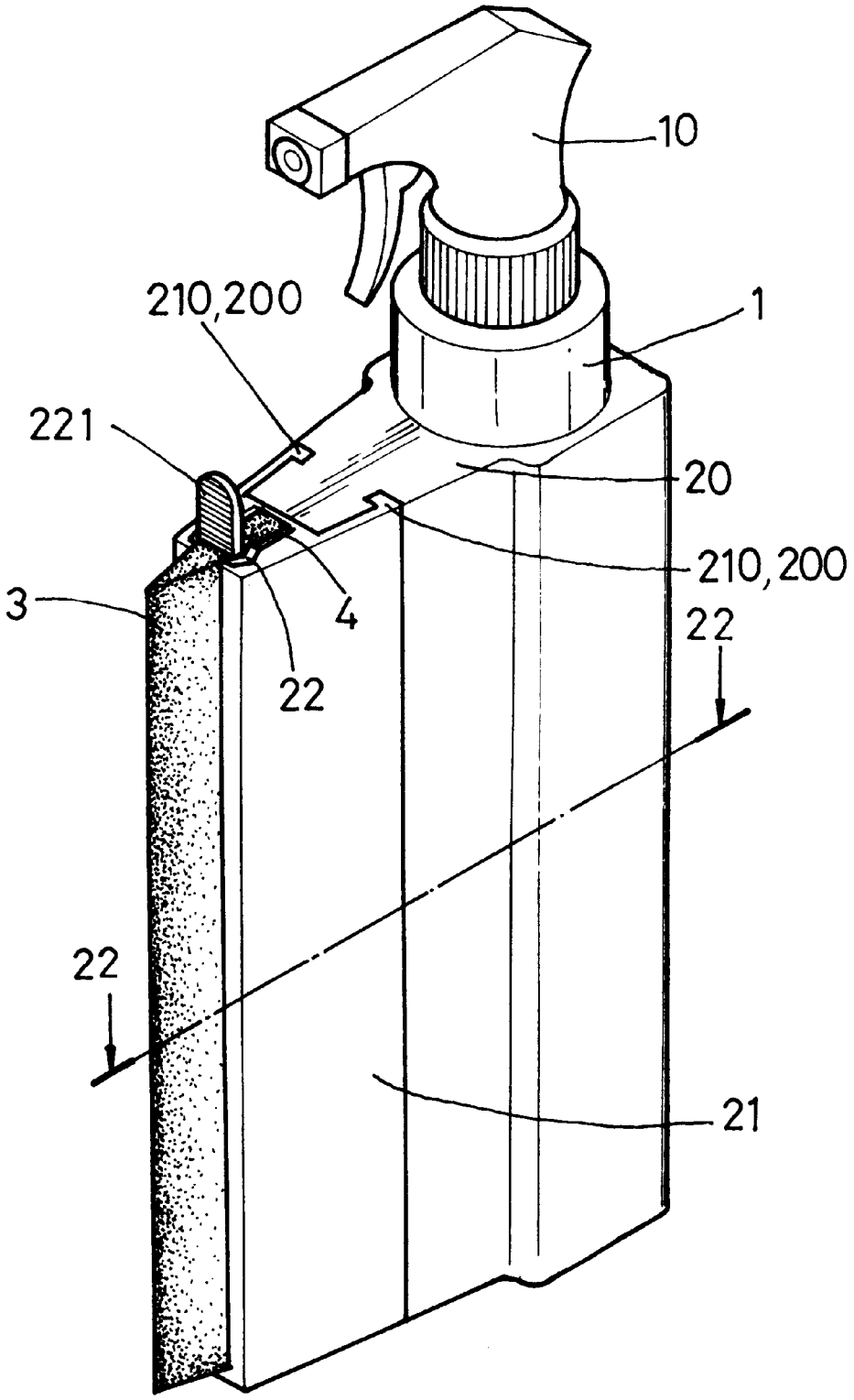
FIG. 21 is a perspective view of the eighth embodiment of a detergent dispenser with a window wiper in the present invention.
Figure 22:
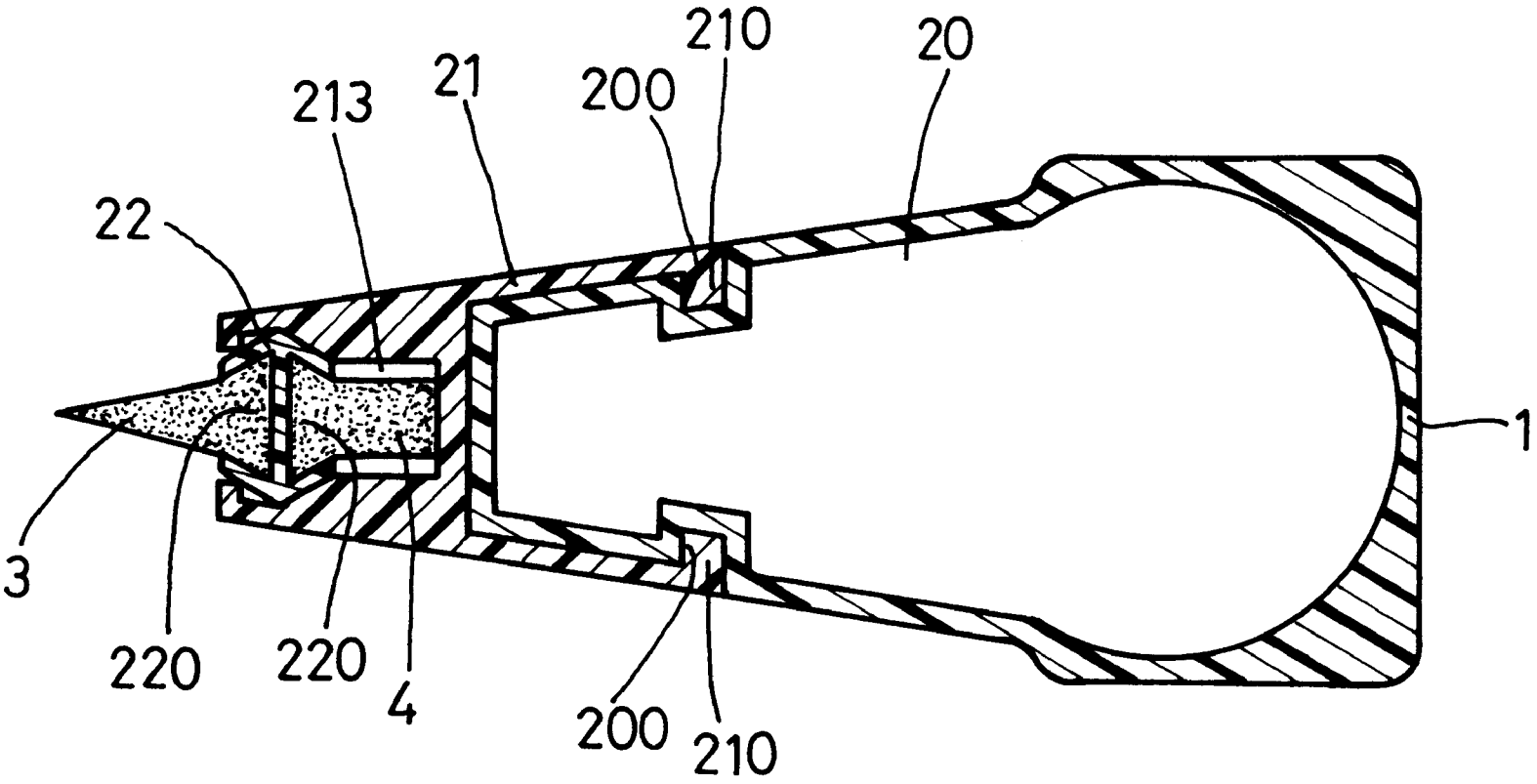
FIG. 22 is a cross-sectional view of line 22—22 in FIG. 21.
Figure 23:
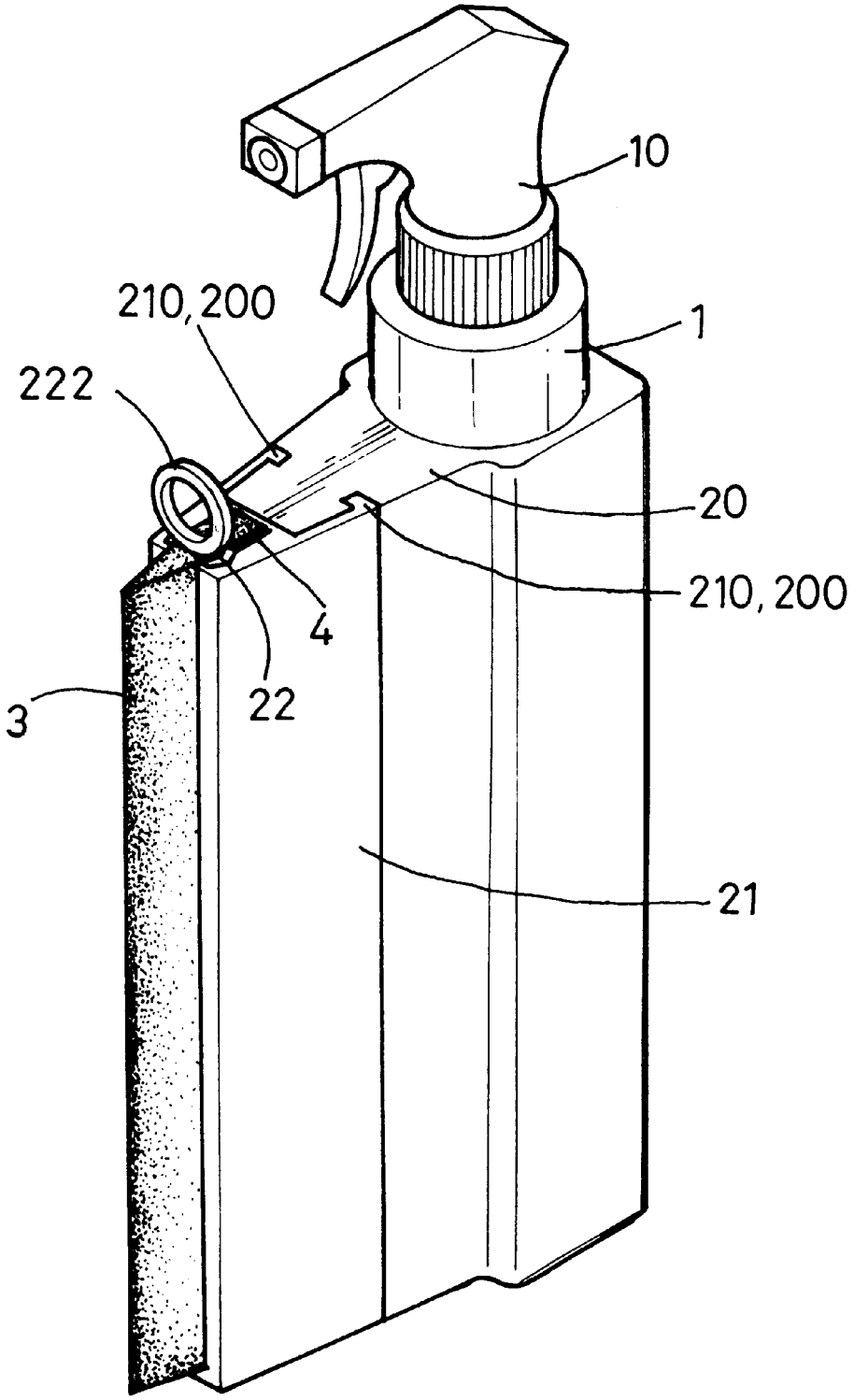
FIG. 23 is a perspective view of the eighth embodiment with a pull ring instead of a grip.
Figure 24:
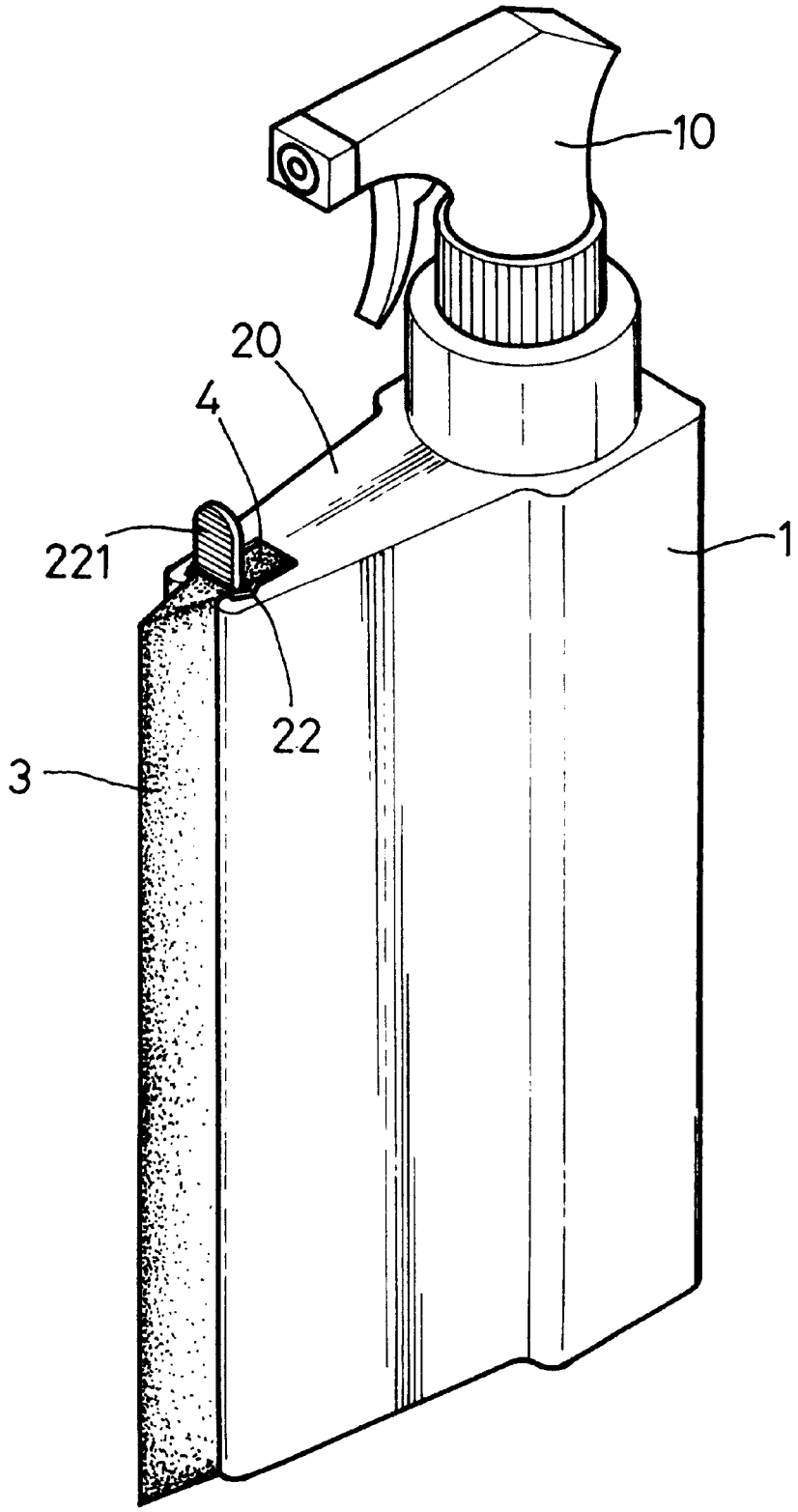
FIG. 24 is a perspective view of a ninth embodiment of a detergent dispenser with a window wiper in the present invention.

FIGS. 21 and 24 respectively show an eighth and a ninth embodiment of the invention, the both embodiments having a great difference from the former embodiments, that two wipers 3 and 4 (two being the same or different) may be combined with the connector 2 at the same time. The main feature of these two embodiments is that the elongate groove 213 or 202 is made larger than those of the sixth and the seventh embodiments for containing a pinching means 22 of a wiper 4. The pinching means 22 has two pinching mouths 220 for pinching respectively the wipers 3 and 4 as shown in FIG. 20. The outer mouth 220 and the front edge of the elongate aperture 213 or 202 are in a line so that the wiper 3 or 4 may protrude out of the aperture or 213 or 202 for a user to use (as shown in FIGS. 21 and 24). Further, a grip 221 is fixed on the location between the the two pinching mouths 220 (i.e. on the pinching means 22 or a pull ring 222 shown in FIG. 23), so as to pull the pinching means 22 out of the aperture 213 or 202. Then the pinching means 22 is turned for 180 degrees to let the wiper 4 to protrude out of the aperture 213 or 202, thus using the wiper 4 instead of 3, and expanding the scope of use and prolonging the usable life of the invention.

Figure 25:
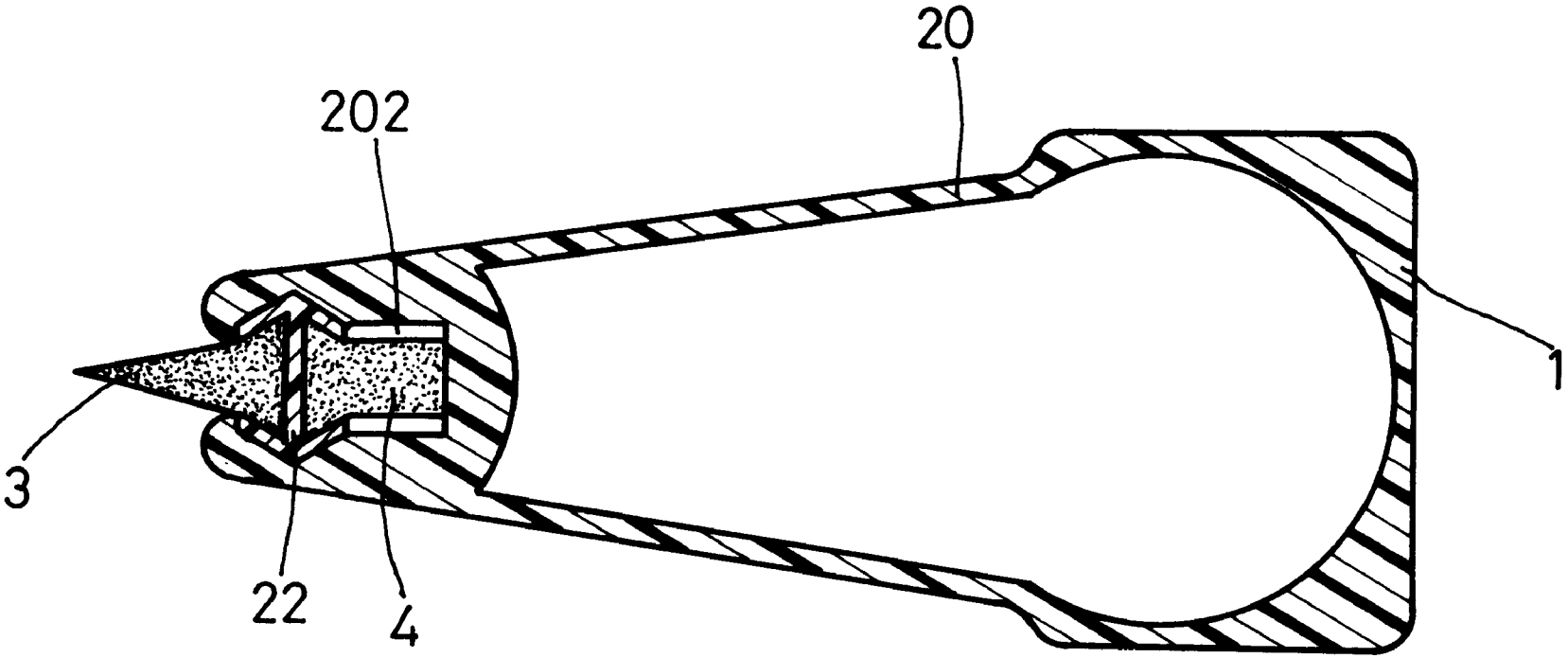
FIG. 25 is a cross-sectional view of a connector formed with a hollow space in its interior.

In order to increase the content of the dispenser body 1, the connector base 20 may form a hollow space abutting on the dispenser body 1 and communicating with the interior of the connector body 1, thus expanding the hollow space in the dispenser body 1 as shown in FIG. 25, and reducing the material needed for the connector base 20 at the same time, resulting in an advantage of saving material. Of course, this provision can also be utilized in the former embodiments, too.

Figure 26:
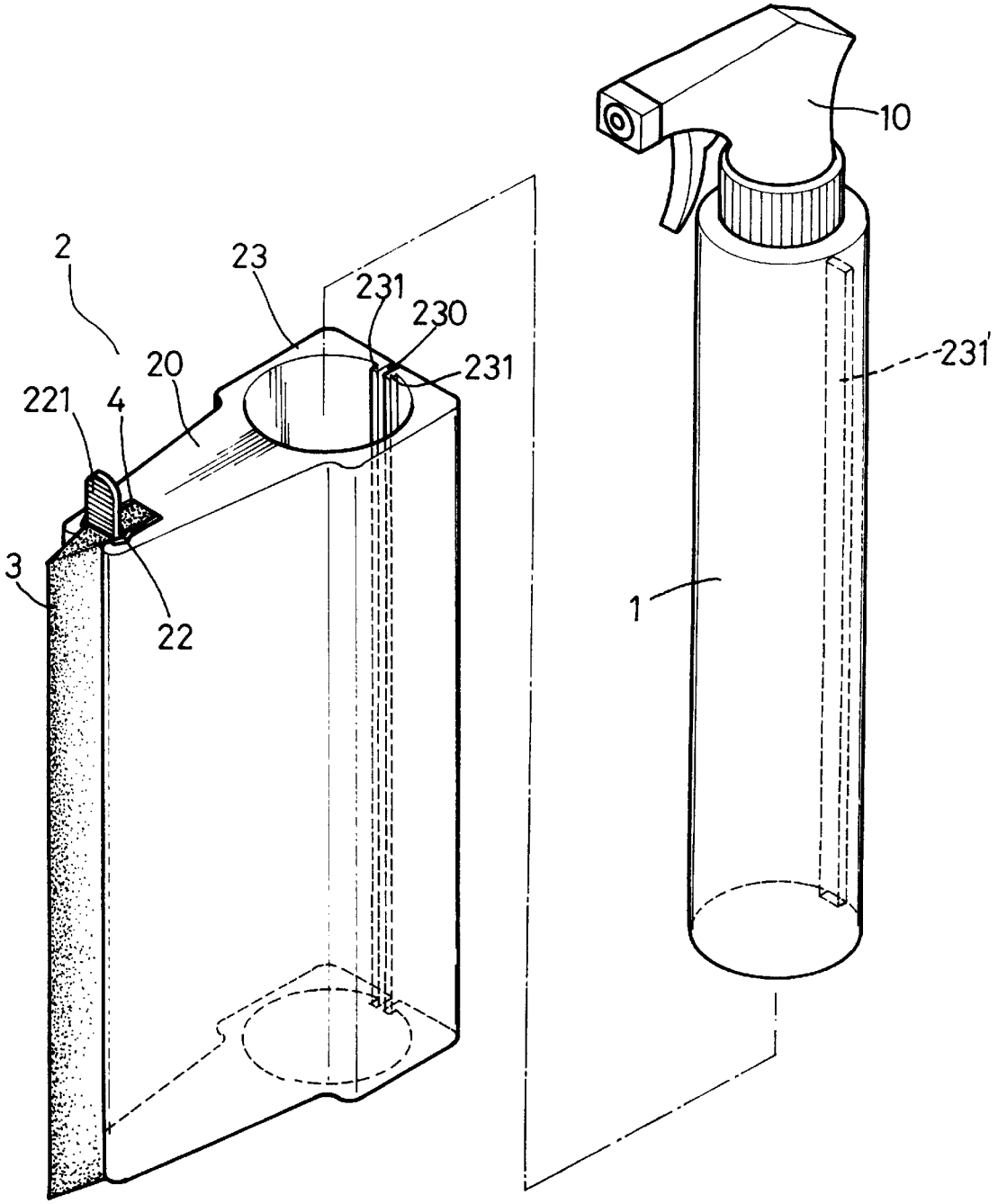
FIG. 26 is an exploded perspective view of a tenth embodiment of a detergent dispenser with a window wiper in the present invention.
Figure 27:
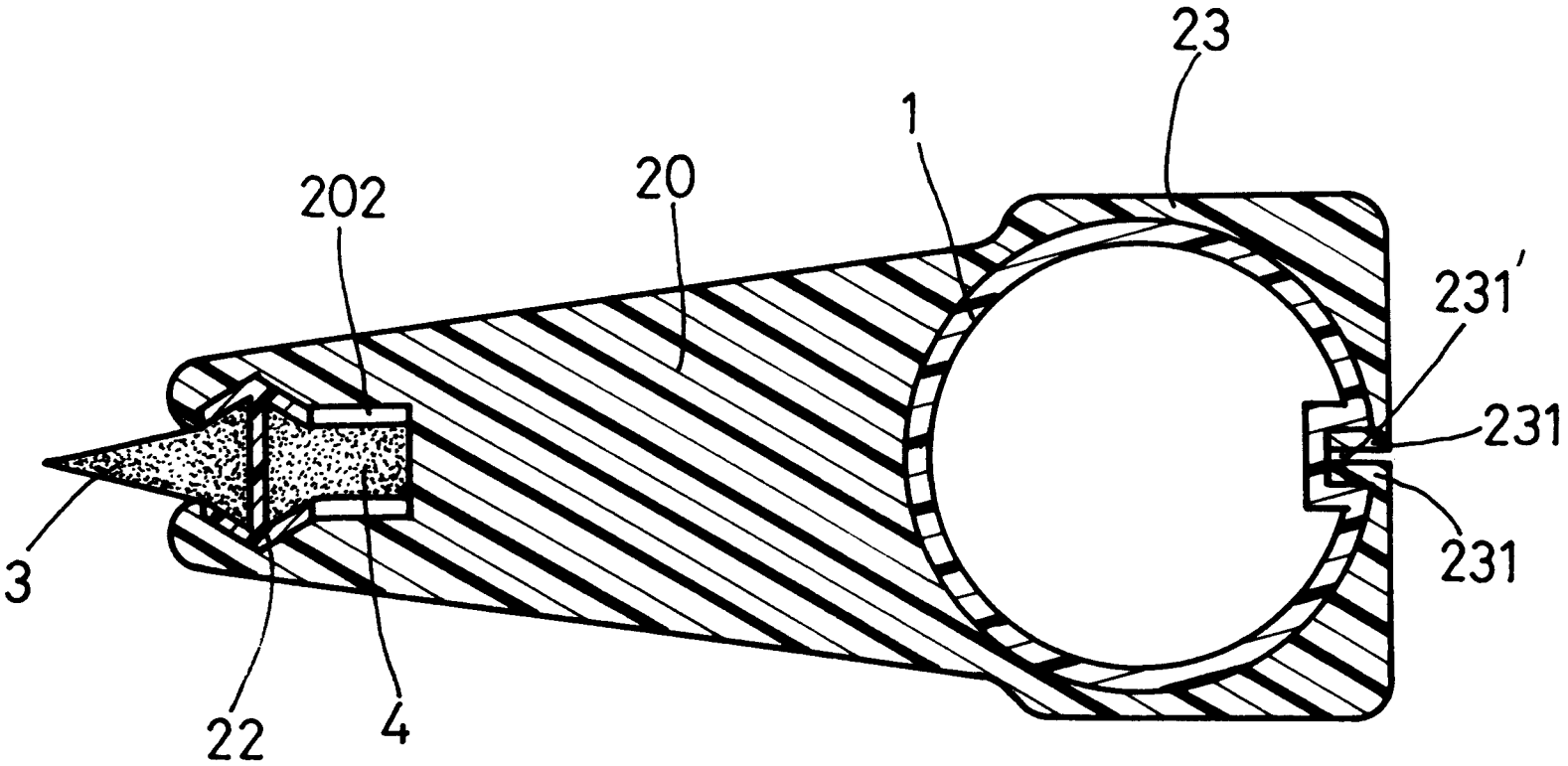
FIG. 27 is a cross-sectional view of the tenth embodiment of a detergent dispenser with a window wiper in the present invention.

FIGS. 26 and 27 show a tenth embodiment of the invention having a chief main difference from the former embodiments in that the connector base 20 has a hollow vertical chamber 23 formed in a rear portion for a dispenser 1 to be inserted therein from upside so as to easily put in and take out the dispenser 1 with respect to the connector base 20. In order to make the dispenser 1 fit in the chamber 23, a vertical through aperture 230 is formed at the rear wall of the chamber 23 so that the diameter of the chamber 23 may be shortened or lengthened to permit the dispenser 1 to be easily moved in or out of the chamber 23. Further, a vertical protruding ridge 231 is formed in an inner side of the vertical aperture 230 and a vertical groove 231' is formed in an outer surface of the dispenser 1 for receiving the vertical ridge 231 as shown in FIG. 27, thus stabilizing the combination of the dispenser 1 with the connector base 20.

Figure 28:
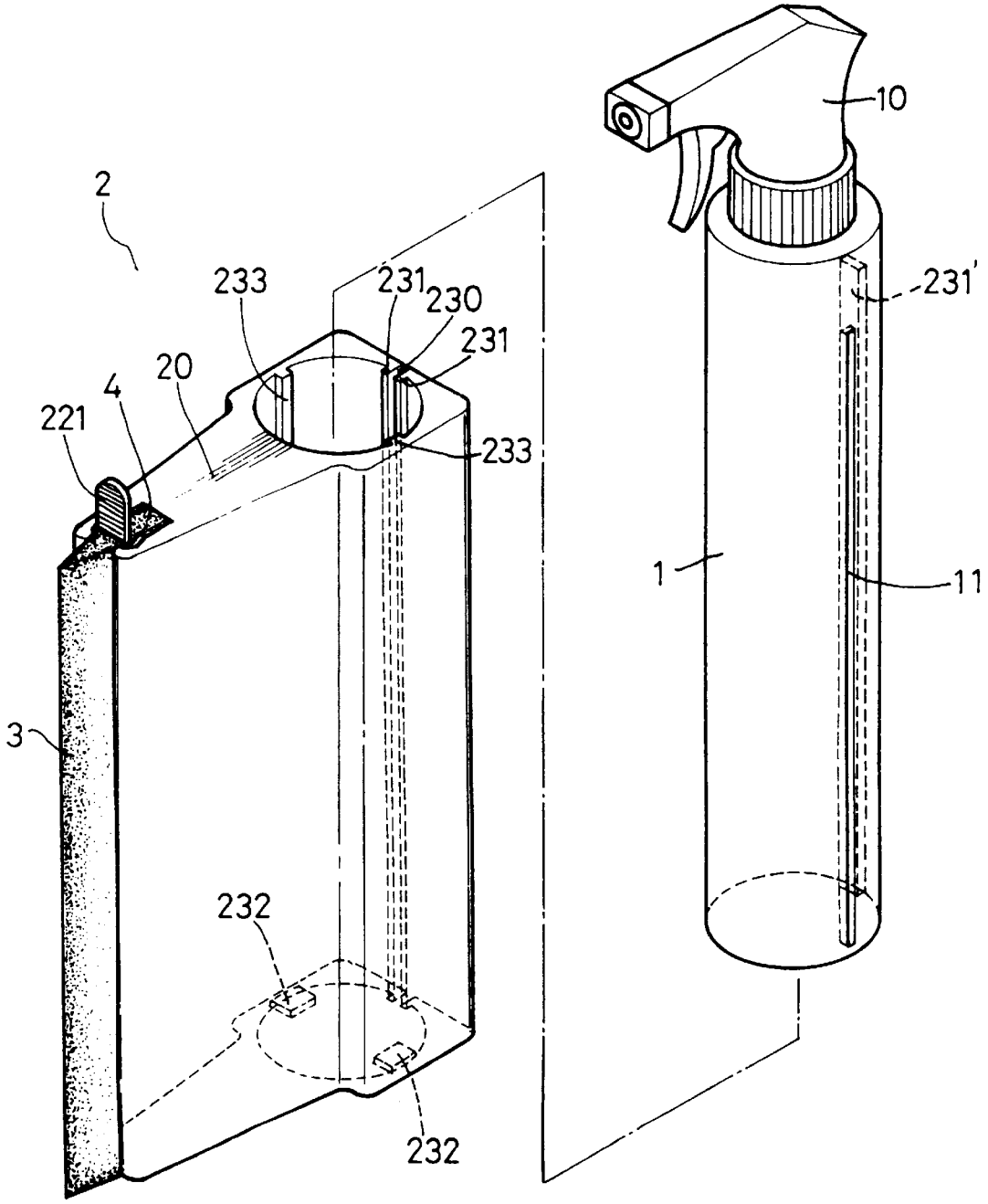
FIG. 28 is an exploded perspective view of an eleventh embodiment of a detergent dispenser with a window wiper in the present invention; and, FIG. 29 is a cross-sectional view of the eleventh embodiment of a detergent dispenser with a window wiper in the present invention.
Figure 29:
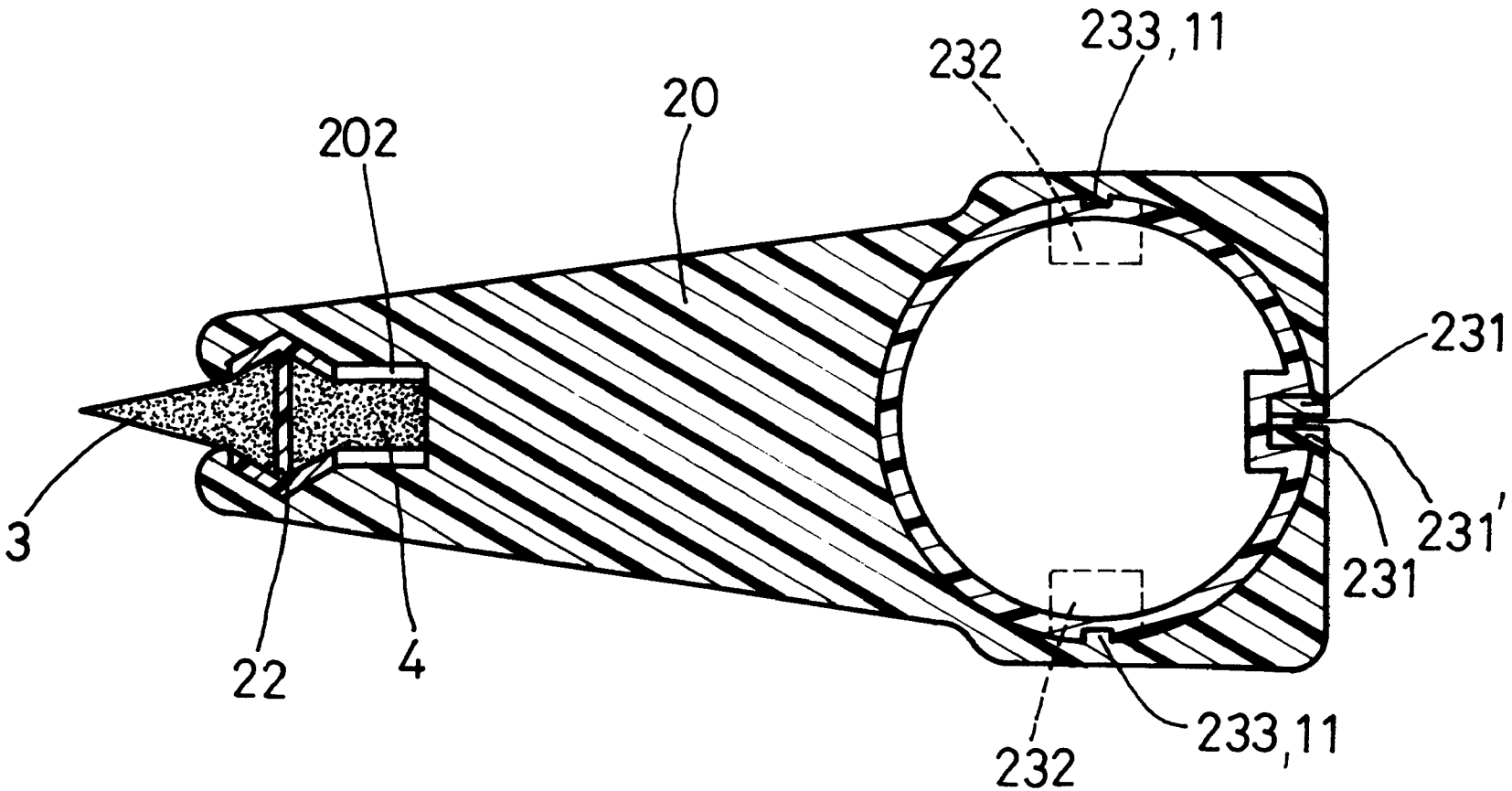

Now referring to FIGS. 28 and 29 showing an eleventh embodiment of the invention, this embodiment improves the combining structure of the dispenser 1 and the connector base 20 of the tenth embodiment, by adding two opposite stop studs 232 formed at the bottom of the chamber 23 for preventing the dispenser 1 from falling down from the bottom, and two vertical projecting ridges 233 formed on an inner wall defining the chamber 23 and two vertical grooves 11 formed in an outer wall of the dispenser 1 to fit with the ridges 233 for preventing the dispenser 1 from rotating after the dispenser 1 is inserted in the connector base 20, as shown in FIG. 29.

As understood from the aforesaid description, the invention includes a dispenser body 1 and a connector 2 fixed with an outer wall of the dispenser body 1, combining a wiper 3 with the connector to integrate the detergent dispenser with a wiper as a unit for cleaning work, not only for cleaning windows, with the dispenser functioning as a grip for the wiper for spraying and cleaning at the same time. It is not only convenient for carrying, but the wiper or the detergent dispenser will never be forgotten by the user. In practical use, the wiper is connected with the connector located between the wiper and the dispenser body, thus preventing a user from touching the wiper. In addition the connector has a rear wide portion and a front narrow portion for a hand of a user to hold easily. Further, the spray nozzle is positioned in the same direction as that of the wiper so that spraying and cleaning may be done without need to, turn the detergent dispenser with a wiper, providing practicability and large effectiveness.

While the preferred embodiments of the invention have been described above, it will be recognized and understood that various modifications may be made therein and the appended claims are intended to cover all such modifications which may fall within the spirit and scope of the invention.

I claim:

1. A detergent dispenser with a window wiper comprising:

a dispenser body having a hollow interior for filling a detergent therein, an upper sealed cap, a compressible spray nozzle fixed on said upper cap for spraying the detergent;

a connector having a connector base fixed vertically on an outer surface of said dispenser body;

a window wiper fitted firmly and vertically on said connector, the wiper having a vertical outer end for use at a distance from said dispenser body;

said dispenser body functioning as a grip for said window wiper for cleaning and a cover vertically closed on the front side of said connector base, said window wiper sandwiched between said cover and said connector base, said cover having a vertical groove in a front side spaced from said dispenser body for the front side of said window wiper to protrude therefrom.

2. The detergent dispenser with a window wiper as claimed in claim 1, wherein said vertical groove contains a pinching means provided with two openings for fitting two window wipers therein at the same time.

3. The detergent dispenser with a window wiper as claimed in claim 1, wherein said connector base has a large hollow interior communicating with the interior of said dispenser body or increasing dimensions for filling a detergent therein.

4. The detergent dispenser with a window wiper as claimed in claim 1, wherein said connector base has a vertical chamber formed in a rear portion for containing said dispenser body therein.

5. The detergent dispenser with a window wiper as claimed in claim 1, wherein said connector base has a vertical chamber formed in a rear portion thereof for containing said dispenser body therein.

6. The detergent dispenser with a window wiper as claimed in claim 5, wherein said vertical chamber has a vertical aperture in its wall, and a vertical projecting ridge is respectively formed at two sides of said aperture, said dispenser body having a vertical groove formed in an outer surface for said vertical projecting ridges to fit therein.

* * * * *